US008545284B2

(12) United States Patent
Baarman et al.

(10) Patent No.: US 8,545,284 B2
(45) Date of Patent: Oct. 1, 2013

(54) INDUCTIVE TOY VEHICLE

(75) Inventors: David W. Baarman, Fennville, MI (US); Richard B. Bylsma, Ada, MI (US); Hai D. Nguyen, Grand Rapids, MI (US); Joshua B. Taylor, Rockford, MI (US); William T. Stoner, Jr., Ada, MI (US)

(73) Assignee: Access Business Group International LLC, Ada, MI (US)

( * ) Notice: Subject to any disclaimer, the term of this patent is extended or adjusted under 35 U.S.C. 154(b) by 654 days.

(21) Appl. No.: 12/622,465

(22) Filed: Nov. 20, 2009

(65) Prior Publication Data

US 2010/0130096 A1 May 27, 2010

Related U.S. Application Data

(60) Provisional application No. 61/116,908, filed on Nov. 21, 2008.

(51) Int. Cl.
*A63H 18/00* (2006.01)

(52) U.S. Cl.
USPC ..... 446/444; 446/446

(58) Field of Classification Search
USPC ..... 446/444
See application file for complete search history.

(56) References Cited

U.S. PATENT DOCUMENTS 3,395,861 A 8/1968 Kindred
3,507,072 A * 4/1970 Hammarberg ..... 446/456
3,596,397 A 8/1971 Colletti
4,078,799 A 3/1978 Lahr
4,272,916 A 6/1981 Giordano et al.
4,415,157 A 11/1983 Lahr
4,438,588 A 3/1984 Martin
4,817,948 A 4/1989 Simonelli
5,175,408 A * 12/1992 Takashima ..... 219/69.14
5,175,480 A 12/1992 McKeefery et al.

(Continued)

FOREIGN PATENT DOCUMENTS

DE 19828376 C1 * 1/2000
EP 0 792 669 12/2001

(Continued)

OTHER PUBLICATIONS

International Search Report, International Application No. PCT/US2009/065234, International Filing Date Nov. 20, 2009.

(Continued)

*Primary Examiner* — Tramar Harper
(74) *Attorney, Agent, or Firm* — Warner Norcross & Judd LLP

(57) ABSTRACT

An inductively powered toy vehicle and an associated track with inductive charging segment. The vehicle may include a secondary coil, a drive motor, an electrical power storage device connected between said secondary coil and said drive motor, and a wireless communications unit. The charging segment may include a primary coil, a sense circuit operable to detect the presence of the vehicle based on a change in the detected impedance of the primary coil, and a power control unit operable to provide a time-varying current to the primary coil when the vehicle traverses the charging segment. The primary coil is positioned within the race track adjacent the track upper surface. The vehicle drive motor may be operable at first and second speed settings, and a remote control device can provide operating instructions to the vehicle wireless communications unit.

33 Claims, 34 Drawing Sheets

(56) References Cited

U.S. PATENT DOCUMENTS

| | | | | |
|---|---|---|---|---|
| 5,203,733 | A | 4/1993 | Patch et al. | |
| 5,218,909 | A * | 6/1993 | Ng | 104/60 |
| 5,767,655 | A | 6/1998 | Ostendorff et al. | |
| 5,974,977 | A | 11/1999 | Johnson et al. | |
| 6,036,574 | A | 3/2000 | Halford | |
| 6,109,186 | A | 8/2000 | Smith et al. | |
| 6,171,171 | B1 | 1/2001 | Barthold | |
| 6,480,110 | B2 * | 11/2002 | Lee et al. | 340/572.5 |
| 6,524,161 | B1 | 2/2003 | Asami | |
| 6,547,634 | B1 | 4/2003 | Chen | |
| 6,568,980 | B2 | 5/2003 | Barthold | |
| 6,762,586 | B2 | 7/2004 | Choi | |
| 7,164,368 | B1 | 1/2007 | Ireland | |
| 7,233,473 | B2 | 6/2007 | Donaldson et al. | |
| 7,243,053 | B1 | 7/2007 | Small | |
| 7,312,590 | B1 | 12/2007 | Kovach, II et al. | |
| 8,049,600 | B2 * | 11/2011 | Beard et al. | 340/13.27 |
| 2001/0028227 | A1 * | 10/2001 | Lys et al. | 315/317 |
| 2004/0090206 | A1 * | 5/2004 | Choi | 320/107 |
| 2005/0148281 | A1 * | 7/2005 | Sanchez-Castro et al. | 446/444 |
| 2006/0087454 | A1 * | 4/2006 | Le | 340/988 |
| 2006/0135035 | A1 | 6/2006 | Leung | |
| 2006/0141901 | A1 | 6/2006 | Hamasaki | |
| 2006/0183405 | A1 * | 8/2006 | Mathews | 446/456 |
| 2006/0266564 | A1 | 11/2006 | Perlman | |
| 2007/0037479 | A1 * | 2/2007 | Margay | 446/444 |
| 2007/0283841 | A1 | 12/2007 | Lopatinsky et al. | |
| 2008/0011184 | A1 | 1/2008 | Lopatinsky et al. | |
| 2008/0014827 | A1 | 1/2008 | Amireh et al. | |

FOREIGN PATENT DOCUMENTS

| | | |
|---|---|---|
| EP | 1849508 | 10/2007 |
| EP | 1 852 167 | 11/2007 |
| EP | 2105179 | 9/2009 |
| JP | S 559288 | 1/1980 |
| JP | S 57211609 | 12/1982 |
| JP | 06-159687 | 1/1996 |
| JP | 2002-210227 | 7/2002 |
| WO | WO 00/54387 | 9/2000 |
| WO | WO 2004/030785 | 4/2004 |
| WO | WO 2004/047303 | 6/2004 |
| WO | 2005053806 | 6/2005 |

OTHER PUBLICATIONS

Written Opinion, International Application No. PCT/US2009/065234, International Filing Date Nov. 20, 2009.

* cited by examiner

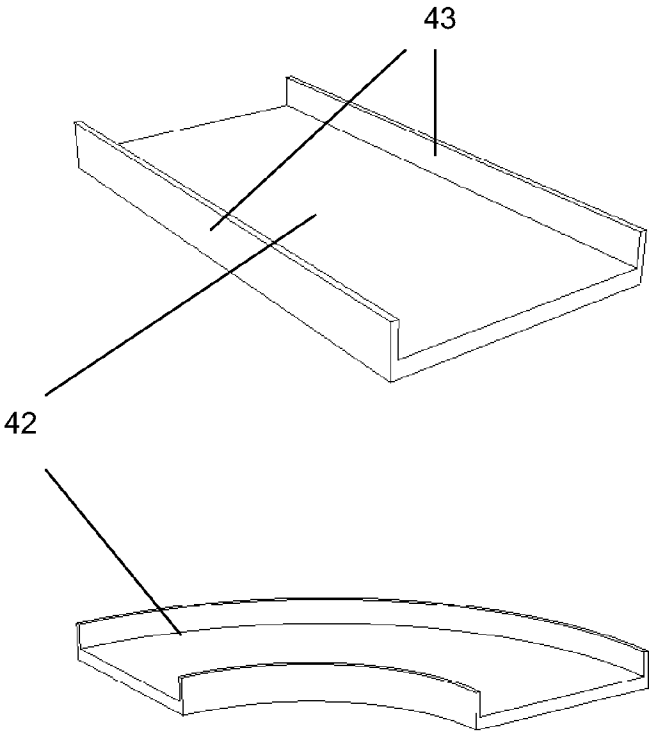
Fig. 2A
Fig. 2B
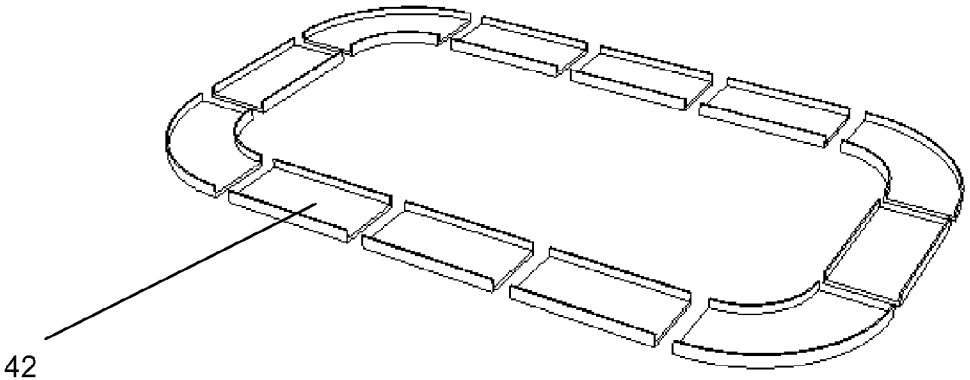
Fig. 2C
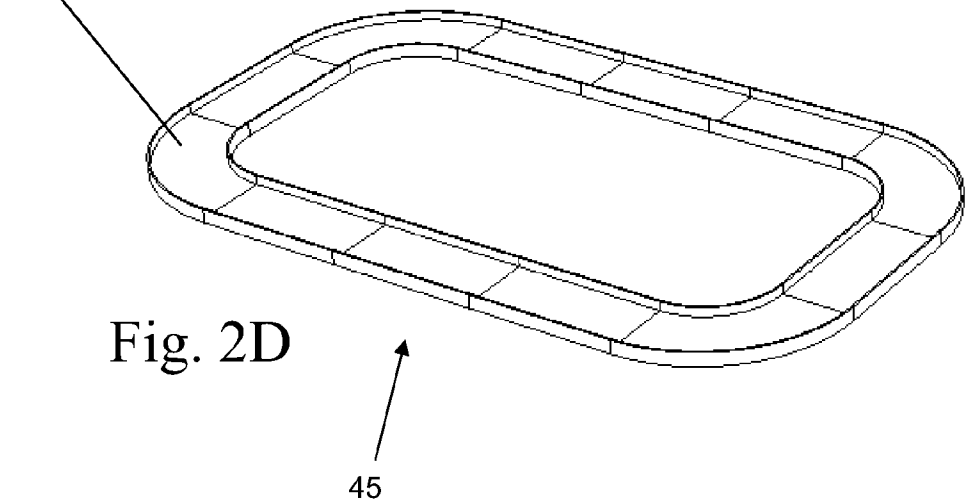
Fig. 2D

INDUCTIVE TOY VEHICLE

This application claims the benefit of U.S. Provisional Application No. 61/116,908, filed Nov. 21, 2008, and entitled "Inductive Toy Vehicle."

BACKGROUND OF THE INVENTION

The present invention relates to providing inductive power to toy vehicles.

Electrically powered race track toys are known. Some are intended for use on a grooved track surface, and are known as slot cars. These toy vehicles or slot cars are designed for use on a segmented electrified track surface that is equipped with a slot, for accepting a guide pin attached to the car, and a pair of electrical contacts on either side of slot, also on the bottom of the car, for contacting matching wires embedded in the track to provide power to the car's electric motor. Other cars are slot-less, and are retained on the track segments by curbs or walls on either side. In the case of slot-less cars, most if not all of the track surface is equipped with electrical contacts to provide power to the car's electric motor.

The toy cars are typically controlled by a hand-held controller, which is connected by wire to the power supplied to the track. By varying the electrical power, such as by a rheostat or digitally, the speed of the cars can be varied according to the user's discretion. In the case of slot cars, steering is generally unavailable, as the slot and pin layout precludes deviation from the slot contained in the track. In slot-less cars, some control may be available by varying the speed of the cars and by utilizing rudimentary steering inputs.

These toy cars, either slotted or slot-less, obtain electrical power required for motion from the track surface. Thus, good electrical conductivity and physical contact is required throughout the entire track surface, or the cars may stop or perform erratically. Consequently, the electrical contacts must normally be kept clean both on the track and on the cars. As the tracks are often placed in dusty areas, such as a floor surface, and electricity attracts lint and other particles, such as dust, users are often required to clean the track and the contacts of the cars for good performance.

Another issue with the track segments involves the connection of the track segments to each other. As the track forms a circuit to conduct electricity from each track segment to the next, a strong connection between segments is normally required. The connection must normally provide considerable strength between adjacent track segments, but also remain easily detachable for track redesign or storage. Over time, these contact areas between track segments can become worn and the conductivity degraded. Additionally, the wires embedded in the track surface can oxidize while exposed to air, reducing the conductivity possible and reducing performance. The user will normally clean the wires with an eraser or contact cleaner to remove the oxidation. This is time-consuming and can be difficult, depending on the length of track to be cleaned. A race track toy that addresses the issues discussed above and provides for more flexibility and user enjoyment is desired.

SUMMARY OF THE INVENTION

The aforementioned problems are overcome by the present invention wherein a vehicle toy system eliminates electrical contacts on both the vehicle and the track, replacing them with inductive elements. A wireless remote control allows users to operate the vehicle without an electrical connection.

One embodiment of the toy vehicle system of the present disclosure includes a track with at least one inductive coil charging portion, one or more toy vehicles, each with inductive coil charging equipment, one or more wireless controllers for operating the toy vehicles, and a power supply that provides power to the at least one inductive coil charging track portion.

Another embodiment of the present disclosure includes an inductive coil track portion that features a primary inductive coil in proximity to the track surface such that a vehicle coming into proximity of the surface receives an electrical charge.

Yet another embodiment of the present disclosure includes a toy vehicle with an inductive secondary coil for receiving electrical power from an inductive coil-equipped track segment.

Another embodiment of the present disclosure includes a toy vehicle with an inductive secondary coil for receiving electrical power from a source that is also connected to an electrical power storage device, such as a capacitor, a battery or the combination thereof.

Another embodiment of the present invention includes an inductive primary coil track segment that detects the presence of a toy vehicle by inductively pinging for the presence of a secondary inductive coil, such as contained within a toy vehicle or remote control device.

An embodiment of the present disclosure includes a toy vehicle with speed/throttle and/or steering controls broadcasting by a wireless control device to a receiver contained within the vehicle.

An embodiment of the present disclosure includes a toy vehicle operable at first and second speed settings based on a detected signal associated with a track, the vehicle including an electromagnetic sensor, a mechanical sensor, or an optical sensor.

An embodiment of the present disclosure includes a toy vehicle with steering operated by an electric relay device using wireless remote control.

An embodiment of the present disclosure includes a toy vehicle or remote controller with power level or other performance indicators, such as light emitting diodes (LEDs) to display information such as charge level remaining.

An embodiment of the present disclosure includes a toy vehicle with steering operated by an electric motor.

An embodiment of the present disclosure includes a toy vehicle with computer controls for monitoring performance, training purposes, and providing entertainment variables.

An embodiment of the present disclosure includes a track portion with a primary inductive coil. The track portion may include a sensor to detect the presence of a vehicle, and provide power to the vehicle's onboard secondary coil.

Another embodiment of the present disclosure is a toy vehicle equipped with a secondary inductive coil, a primary inductive coil power station, and a remote control device for operating the toy vehicle.

These and other objects, advantages, and features of the invention will be more fully understood and appreciated by reference to the description of the current embodiment and the drawings.

It will be readily understood that the components of the present disclosure, as generally described and illustrated in the figures herein, may be arranged and designed in a wide variety of different configurations. Thus, the following more detailed description of the embodiments of the apparatus, system, and method of the present disclosure, as represented in accompanying figures, is not intended to limit the scope of the disclosure, as claimed, but is merely representative of selected embodiments of the disclosure.

Reference throughout this specification to "one embodiment" or "an embodiment" (or similar) means that a particular feature, structure, or characteristic described in connection with the embodiment is included in at least one embodiment of the present disclosure. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples, to provide a thorough understanding of embodiments of the present disclosure. One skilled in the art will recognize, however, that the disclosure can be practiced without one or more of the specific details, or with other methods, components, materials, etc. In other instances, well-known structures, materials, or operations are not shown or described in detail in order to avoid obscuring aspects of the disclosure.

The illustrated embodiments of the disclosure will be best understood by reference to the drawings, wherein like parts are designated by like numerals or other labels throughout. The following description is intended only by way of example, and simply illustrates certain selected embodiments of devices, systems, and processes that are consistent with the disclosure as claimed herein.

BRIEF DESCRIPTION OF THE DRAWINGS

FIGS. 2A-D disclose a race track toy according to at least one embodiment of the present disclosure.

DESCRIPTION OF THE CURRENT EMBODIMENT

Figure 1:
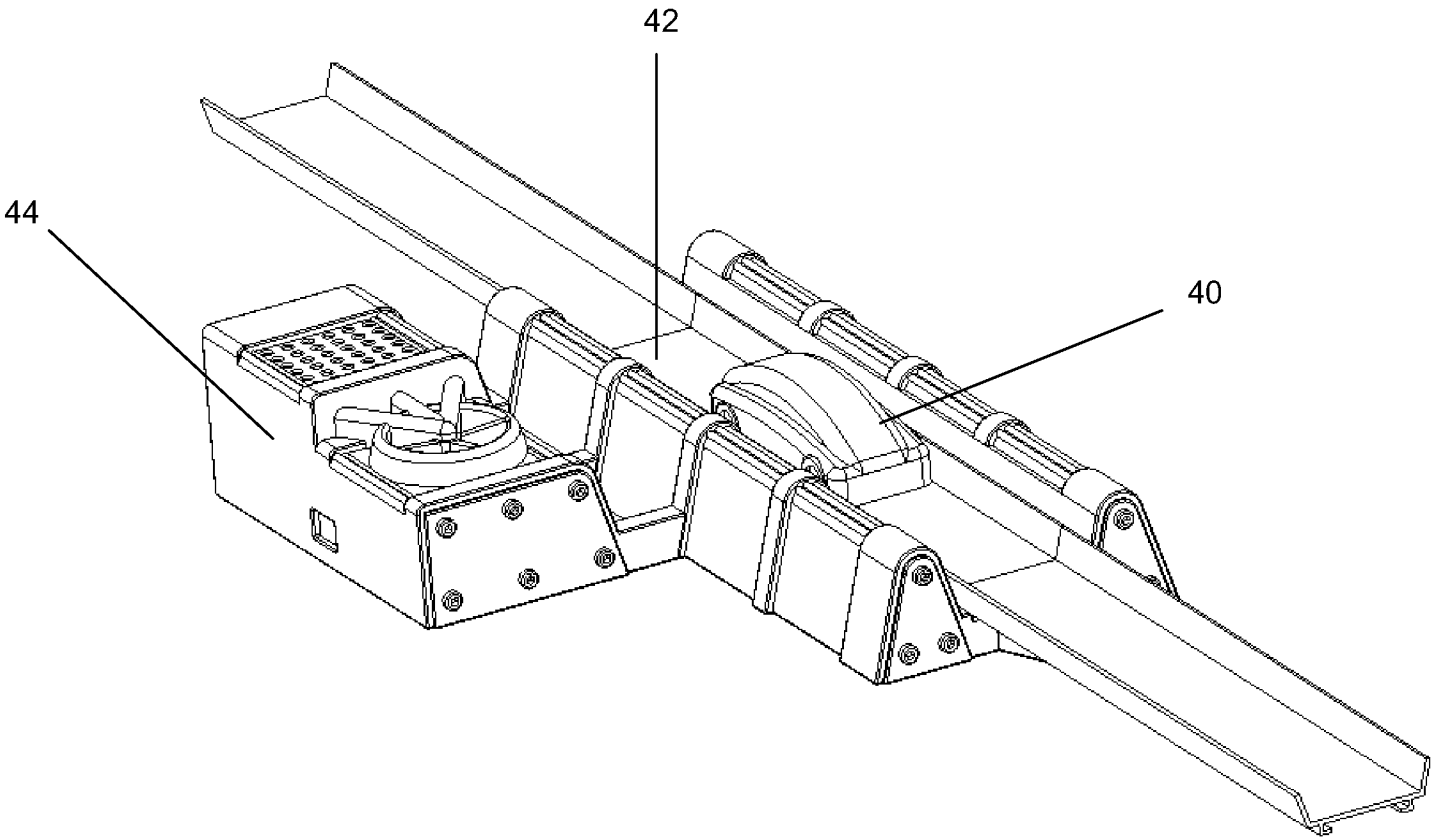
FIG. 1 is a perspective view of a track and associated toy vehicle in accordance with an embodiment of the present invention.

With reference to FIG. 1, a toy vehicle system including an inductively powered toy vehicle 40, at least one track segment 42, and an associated control module 44 is shown. The vehicle 40 is drivable on a track including at least one segment 42 having a wireless power supply to generate an inductive field, wherein the vehicle 40 receives power from the inductive field when it traverses the track segment 42. Though shown as adapted for use on a circuit formed of multiple interconnected track segments 42, the toy vehicle 40 may also be used with only a single track segment 42 in combination with any suitable driving surface. With reference to FIGS. 2A-2D, track segments 42 may be straight, curved, a combination of both, or other shapes, such as an intersection or a pit road track segment. Plastic or other formable material may be used to construct the track segments, which optionally include connectors (not shown) to join other track segments together. These connectors allow for a smooth transition surface or joint between the track segments so as to allow for the toy cars or vehicles to pass between sections unhindered. Additionally, the optional connectors also allow for users to quickly disconnect the track segments to make alterations to the track layout or assemble a new circuit. As shown in FIG. 2B, the track segment 42 is curved in a constant radius, to allow the vehicles to make a ninety degree turn. Track segments 42 may be formed of any shape however, such as an intersection, sweeping curve, or other shape. Optional lateral barriers or guard rails 43 may be used to contain the toy vehicles on the track surface, since the toy vehicles can be steerable and guide pins are unnecessary. The guard rails 43 can help prevent vehicles from exiting the track segments 42, unless using specific segments equipped with exit ramps (not shown) where fences are omitted. The track segments 42 can be easily presented in a circuit format as shown in FIG. 2C, where a number of straight and curved segments 42 or portions are arranged to form a circuit. Using the integrated connectors of the track segments 42, a complete circuit 45 is shown in FIG. 1D, whereby vehicles may lap repeatedly without leaving the circuit 45 due to the guard rails 43.

Figure 3:
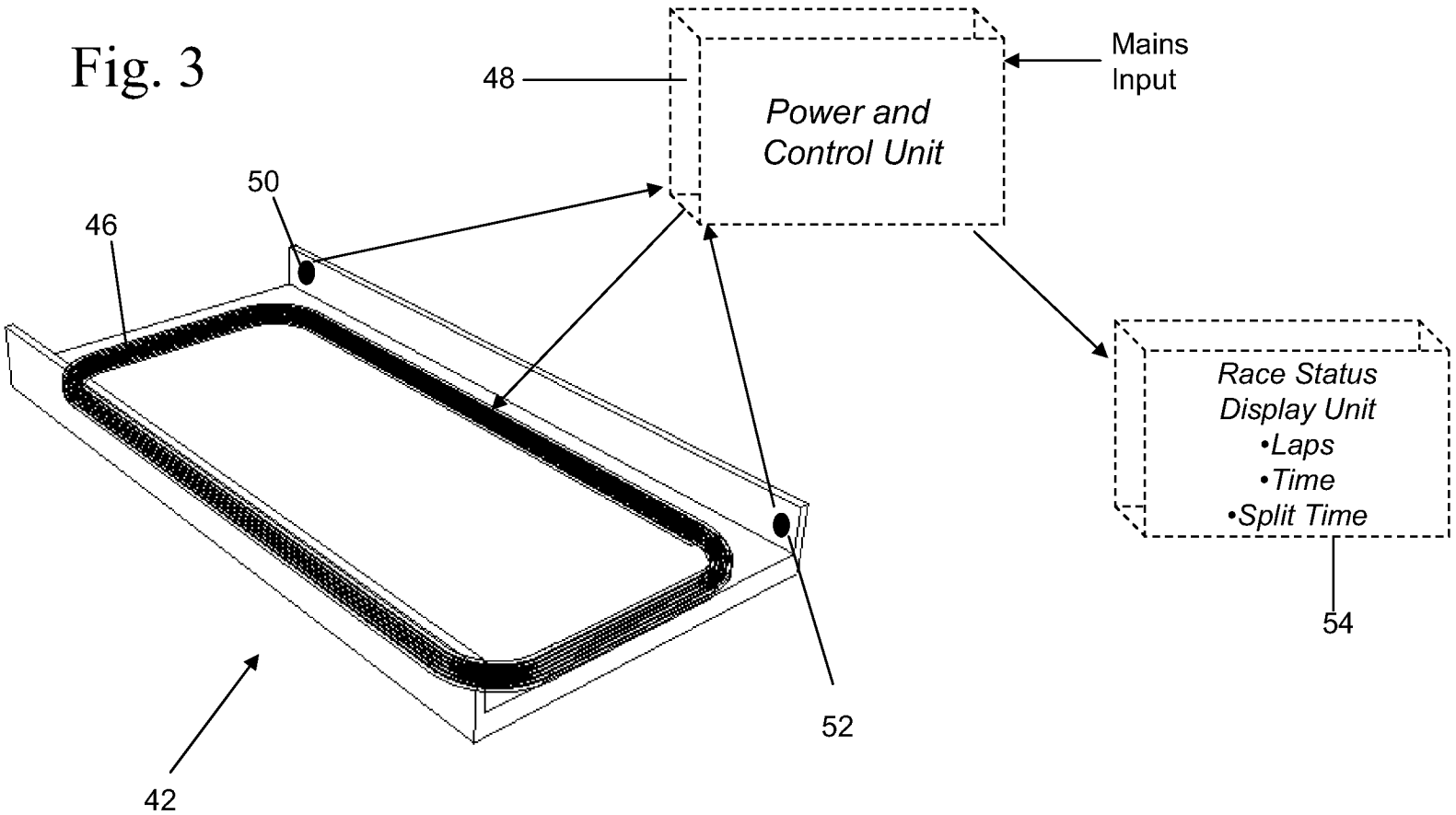
FIG. 3 discloses a race track toy according to at least one embodiment of the present disclosure.

A track segment 42 with a primary inductive element 46 is shown in FIG. 3. The primary inductive element 46 can be any conductive element operable to produce a magnetic field when subject to a time-varying current, including a coil, for example. A power and control unit 48 receives AC mains power from an external source (not shown), such as a wall outlet, and transforms and rectifies it to supply power to the track segment 42. At least one optional sensor 50, 52 is shown as a component to the track segment 42. The sensor 50, 52 can detect the presence of a vehicle entering and/or exiting the track segment 42. In one embodiment, a signal may be communicated from the sensor 50, 52 to the power and control unit 48 to power up the primary coil 46 if the sensor 50, 52 indicates that a vehicle is entering the track segment 42 and power down the primary coil 46 if a vehicle is leaving the segment 42. Additionally, the sensor 50, 52 may provide information for an optional race status display unit 54. The optional race status display unit 54 may display information such as the vehicle's lap speed and other performance parameters such as lap time, place, or other pertinent data. Optionally, the vehicle 40 may be uniquely identified using specific resonant signals or other electronic marking, such as digital technology, and the display unit 54 can determine which vehicle has entered the track segment 42, or if multiple vehicles 40 enter, their places can be accurately determined. The optional sensors 50, 52 may be embedded within the track surface 56, side rails 42, or attachable using a fastening method, such as snap-on or adhesive. In this way, additional sensors 50, 52 can be placed about the track 45 to measure performance in portions of a circuit, such as a racing training aid or performance meter. While one primary inductive coil 46 is shown in a track segment 42 in FIG. 3, multiple primary coils may be included in a track segment 42 or other application suitable for coil shapes, such as a pad, start/finish line, or other suitable surface for engagement with a vehicle. For example, a plurality of primary coils arranged in a staggered pattern or an array of coils allows for power to be transferred to vehicles with secondary coils in a number of variations.

Figures 4A, 4B, 4C, 4D:
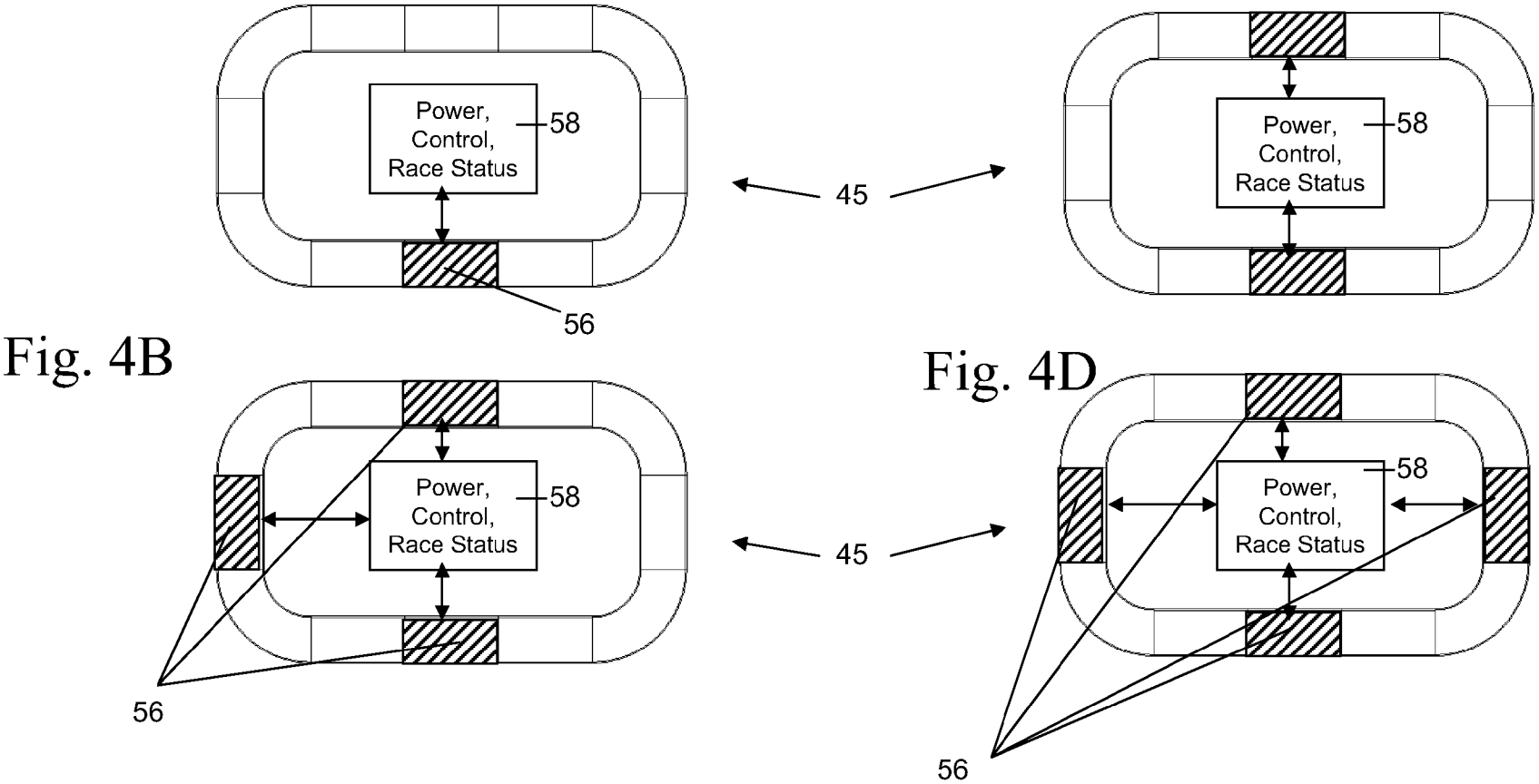
FIGS. 4A-D disclose a plurality of race track toy embodiments.

FIGS. 4A-D are illustrations of various race track arrangements. A primary inductive coil segment or charging portion 56 is shown as a part of a race track circuit 44. For illustrative purposes only, an oval is shown; however a circuit of any shape may be constructed. The primary inductive coil segment 56 is connected to a power, control, and race status unit 58 which provides mains power and optionally processes race car performance data from the sensors (not shown) included in the track segment(s) 56. In another embodiment as shown in FIG. 4B, two primary inductive coil segments 56 are shown as a portion of a race track circuit 45. For both segments 56, power, control, and race status unit connections may be provided. In another embodiment as shown in FIG. 4C, three primary inductive coil segments 56 are shown as a portion of a race track circuit 45, each may be provided with connection to the power, control, and race status unit 58. In yet another embodiment as shown in FIG. 4D, four primary inductive coil segments 56 are shown as a portion of a race track circuit 45, each provided with connection to the power and race and control unit 58. By utilizing multiple primary coil track segments 56, the toy vehicle 40, for example a race car 60, may receive additional charging opportunities; data may be gathered about their performance in multiple sections of the track, as well as other performance or entertainment data. For example, one primary coil segment 56 could be located in a pit area, such that a vehicle 40 may pause and "refuel" by charging inductively. Additionally, the control unit may retain a vehicle 40 in a segment 42 by sending a signal to the vehicle to deactivate it for a period of time, such as to serve a penalty or "black flag".

Another feature of the present disclosure is the adaptability of the track segments 56 with inductive coils 46 to be equipped with adapters for use with other existing and future track circuits and vehicles, or as a stand-alone additional accessory for vehicles not requiring a track circuit. For example, an adapter attached to a track segment with inductive coils may be inserted into a track system, allowing for vehicles equipped with inductive secondary coils to use the track circuit. Further, the remote controllers may also receive charging from the inductive track segment 56 due to their own on-board secondary coils.

Figure 5A:
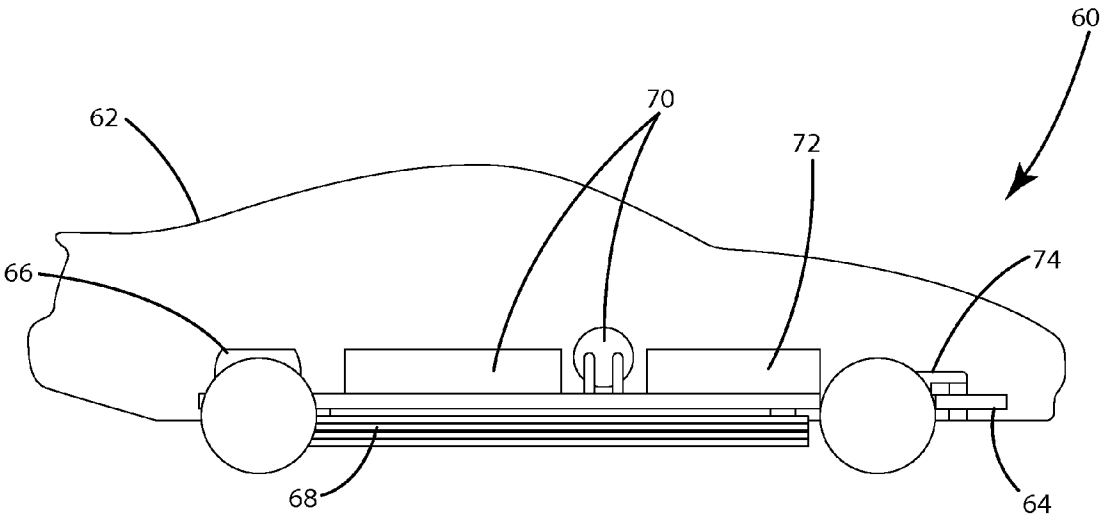
FIGS. 5A-B disclose a toy vehicle according to at least one embodiment of the present disclosure.
Figure 5B:
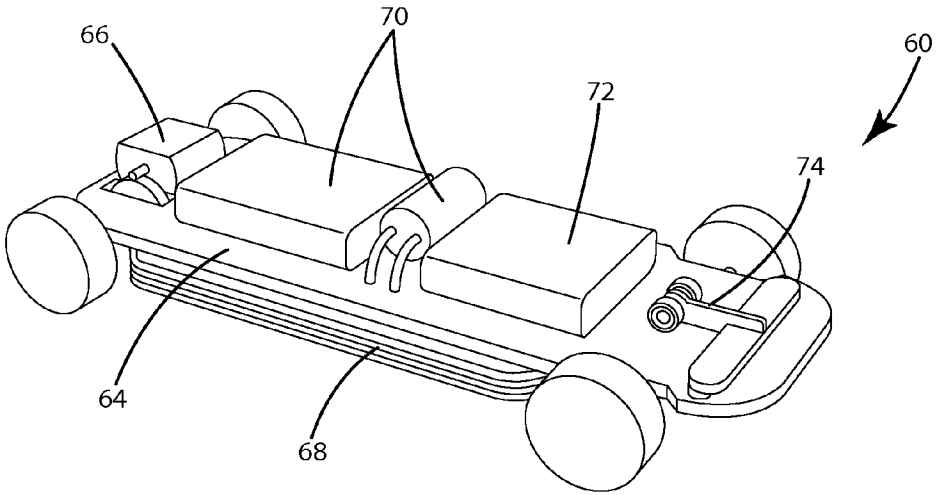
Figure 6:
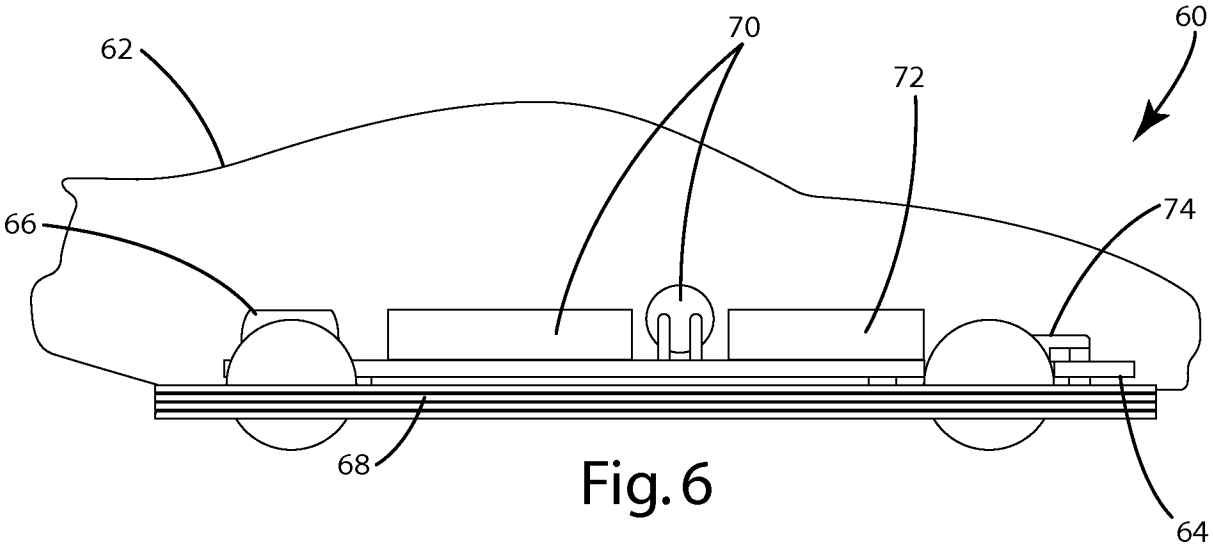
FIG. 6 discloses a toy vehicle in accordance with at least one embodiment of the present invention.

FIGS. 5A-B are illustrations of a race car 60 according to at least one embodiment of the disclosure. As shown in FIG. 5A, the race car 60 can include a body shell 62 and chassis 64 with various components. FIG. 5B shows the race car 60 with the body shell 62 removed, revealing the chassis 64 with various components. The drive motor 66 is shown, which is equipped with a gear that engages a second gear located on a drive shaft, connected to a pair of wheels. Note that in this embodiment, the rear wheels of the race car 60 are the drive wheels, but in other embodiments, the race car 60 may have front wheel drive or all wheel drive. Additionally, other means of providing power to the wheels may be used, such as a belt drive system, or individual motors may be located at some or all of the wheels. On the bottom of the chassis 64 is the secondary inductive element 68, which selectively receives electrical power when in proximity to a track segment 42 containing a primary inductive coil 46. The secondary inductive element 68 can be any conducting element adapted to generate a current when subject to a time-varying magnetic field, including a secondary coil, for example. The energy storage system 70 is shown in the middle portion of the chassis 64 in this embodiment, but may be located elsewhere on the chassis 64. As the coil 68 is energized, electrical power is transferred to the energy storage system 70, which may include a battery, a capacitor, a combination of both, or another suitable energy storage device. A microcontroller 72 includes an RF receiver or other wireless communications device and is optionally located on the chassis 64. The microcontroller 72 receives signals from a control unit (not shown) which is operated by the user, by the track control unit, or by internal control circuitry, such as a pace car or training aid. The microcontroller 72 can regulate the race car speed, steering, and other control features, such as lights. In the current embodiment, the steering mechanism 74 includes a relay, servomotor, or other means for changing the front wheel direction so as to allow the user to steer the race car 60. Additionally, the rear or all wheels may also feature steering for additional performance. As shown in FIG. 6, the secondary coil 68 can optionally extend beyond the length and width of the wheel base of the car 60, or circumferentially encompass the each of the four tractive wheels. This configuration can achieve an enhanced transfer of power, with the secondary coil 68 optionally functioning as a bumper for the car 60 during racing.

Figure 7:
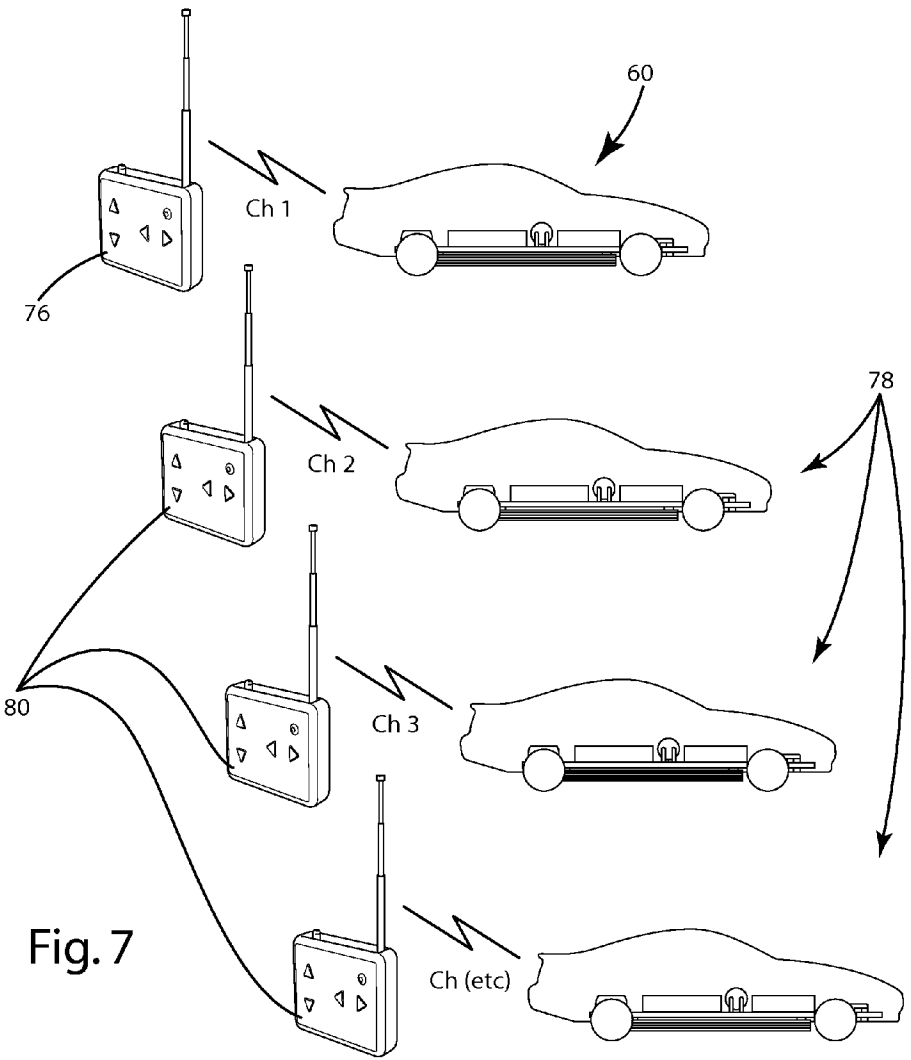
FIG. 7 discloses a plurality of toy vehicles and remote controls according to at least one embodiment of the present disclosure.

FIG. 7 illustrates a race car controller 76 and a race car 60. Additional race cars 78 may be controlled by additional controllers 80 with complimentary, non-interfering, independent wireless communication. A controller 76 is shown with a number of control options, such as speed setting, steering, and braking. Other, different, or fewer controls may also be included, such as a graphic display providing car data, light control, battery power remaining in the car and controller, as well as other features. A wireless link may be established between the controller 76 and race car 60. This link allows for the user to operate or drive the car 60 around a track circuit 45 or outside of a track circuit 45 if desired. The car 60 may be recharged by driving it onto or over a primary coil track segment 56 or other embodiment of a track segment, such as a pit stop or gas station (not shown). The wireless communication may be RF, infrared, Bluetooth, or some other wireless communication method. Optionally, the controller 76 may include variable speed control and continuous steering control instead of discrete steering inputs.

Figure 8:
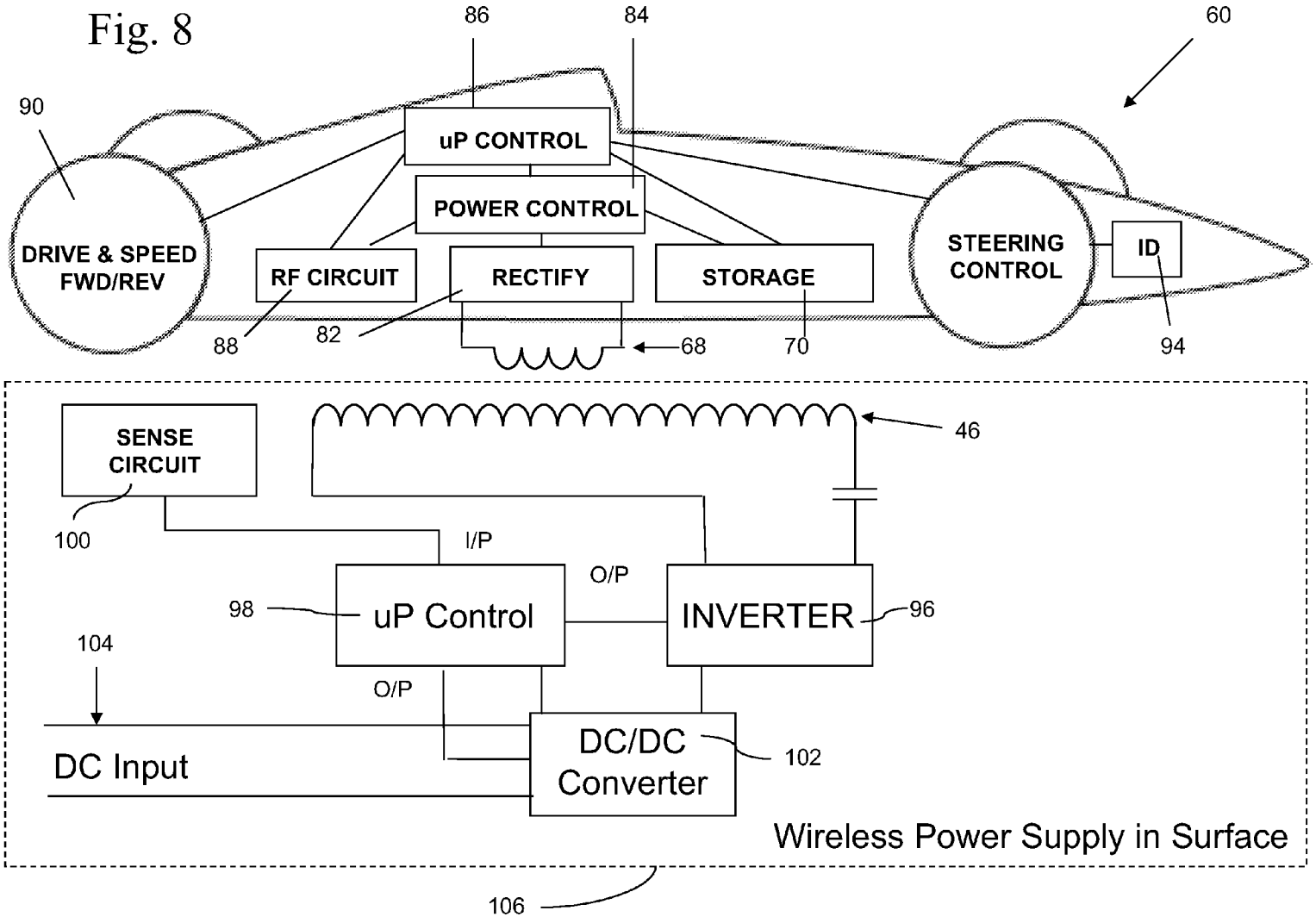
FIG. 8 discloses a toy vehicle with secondary inductive coil and controls, and a track segment with primary inductive coil and power supply control system, according to at least one embodiment of the present disclosure.

FIG. 8 is a cutaway view of a toy race car 60 including a secondary inductive coil 68 located on the car chassis 64, which receives energy and transfers it to storage device 70. The energy may be rectified in an optional rectify unit 82. A power control 84 and a microcontroller 86 receive energy from the storage device 70, which may be a battery, capacitor, combination of both or other suitable energy storage device. An RF communications circuit 88 receives energy from power control 84 and the microcontroller 86, and can receive and transmit wireless signals to the user controller (not shown) to operate the race car 60. A Drive and Speed FWD/REV unit 90 is shown, which in this embodiment is the rear drive wheels, including an electric motor and gear system. Steering control 92 is shown at the front of the race car 60, which receives signals from the microcontroller 86, which in turn receives signal commands from the user remote control (not shown) as to which direction the user desires the race car to move. An ID unit 94 is shown within the race car 60, which includes unique car information that may be transmitted to the race track power and race control unit (not shown). Such ID information could include type of vehicle, performance level, driver ID, or other information.

The drive motor 66 can be operated at multiple speed settings based on a detected signal associated with a portion of the track 45. For example, a first speed setting could be set by the vehicle microcontroller 86 to prevent the drive motor 66 from draining the energy storage device 70 to quickly. A second speed setting could be set by the microcontroller 86 to provide increased vehicle speed during short intervals in which increased vehicle speed is desired, e.g., in a run-up to a ramp or loop. The microcontroller 86 can switch between speed settings in response to a signal associated with a portion of the track 45, for example, an inductively powered track segment 56. Upon receiving the signal, optionally through the secondary coil 68 or the RF circuit 88, the microcontroller 86 could control the drive motor to increase or decrease the power drawn from the storage device 70. The change in drive motor control could be momentary (i.e., pre-set for a period of time) or permanent (i.e., continuing until a second signal is detected during the course of the vehicle's movement about the track). As discussed in greater detail below, the signal can also be generated by a magnet in combination with a Hall Effect sensor, an LED in combination with a photodiode, or a mechanical switch in combination with an actuator, for example.

Figure 9:
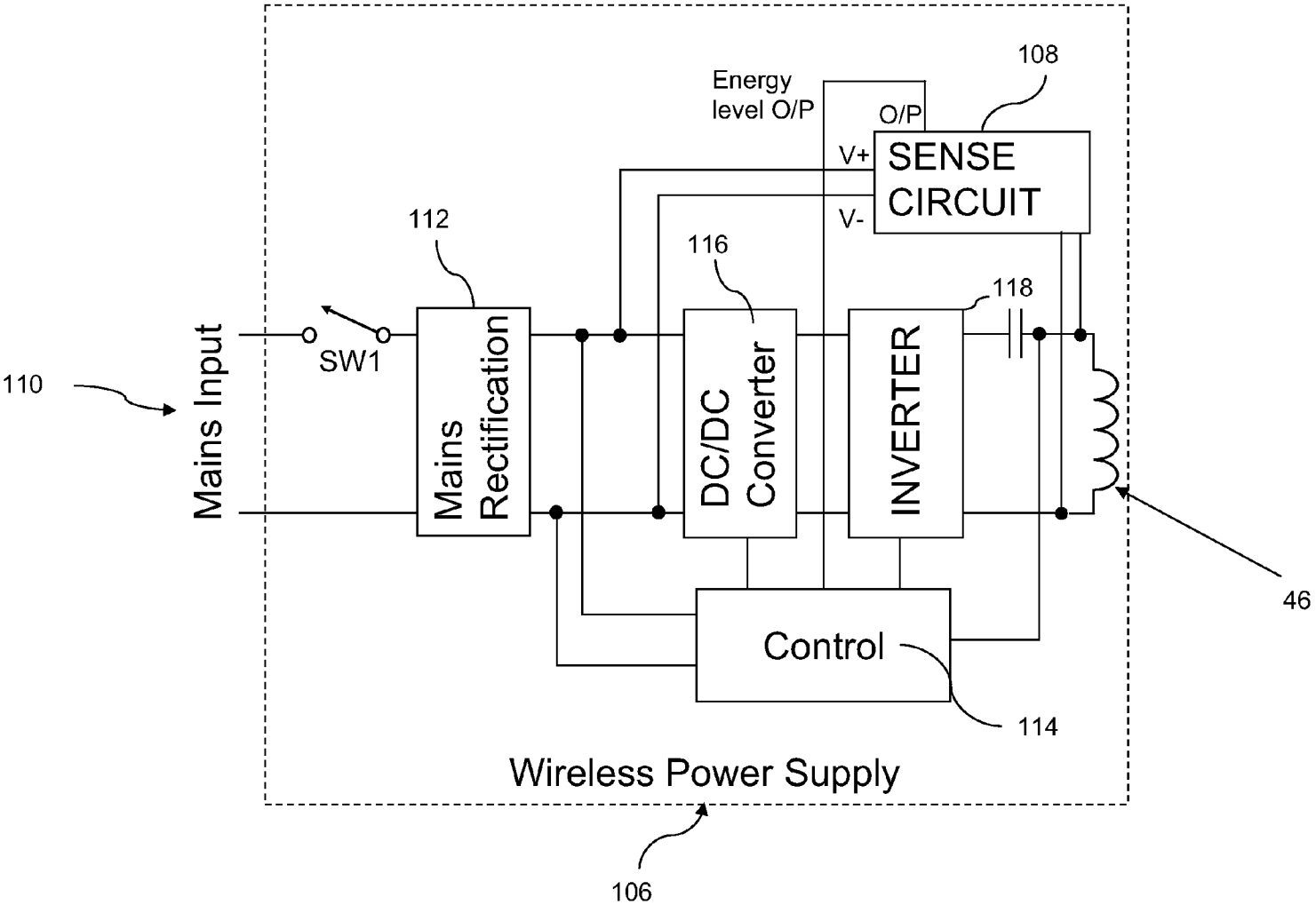
FIG. 9 discloses a circuit diagram for an inductive power track segment with inductive sense circuit according to at least one embodiment of the present disclosure.
Figure 10:
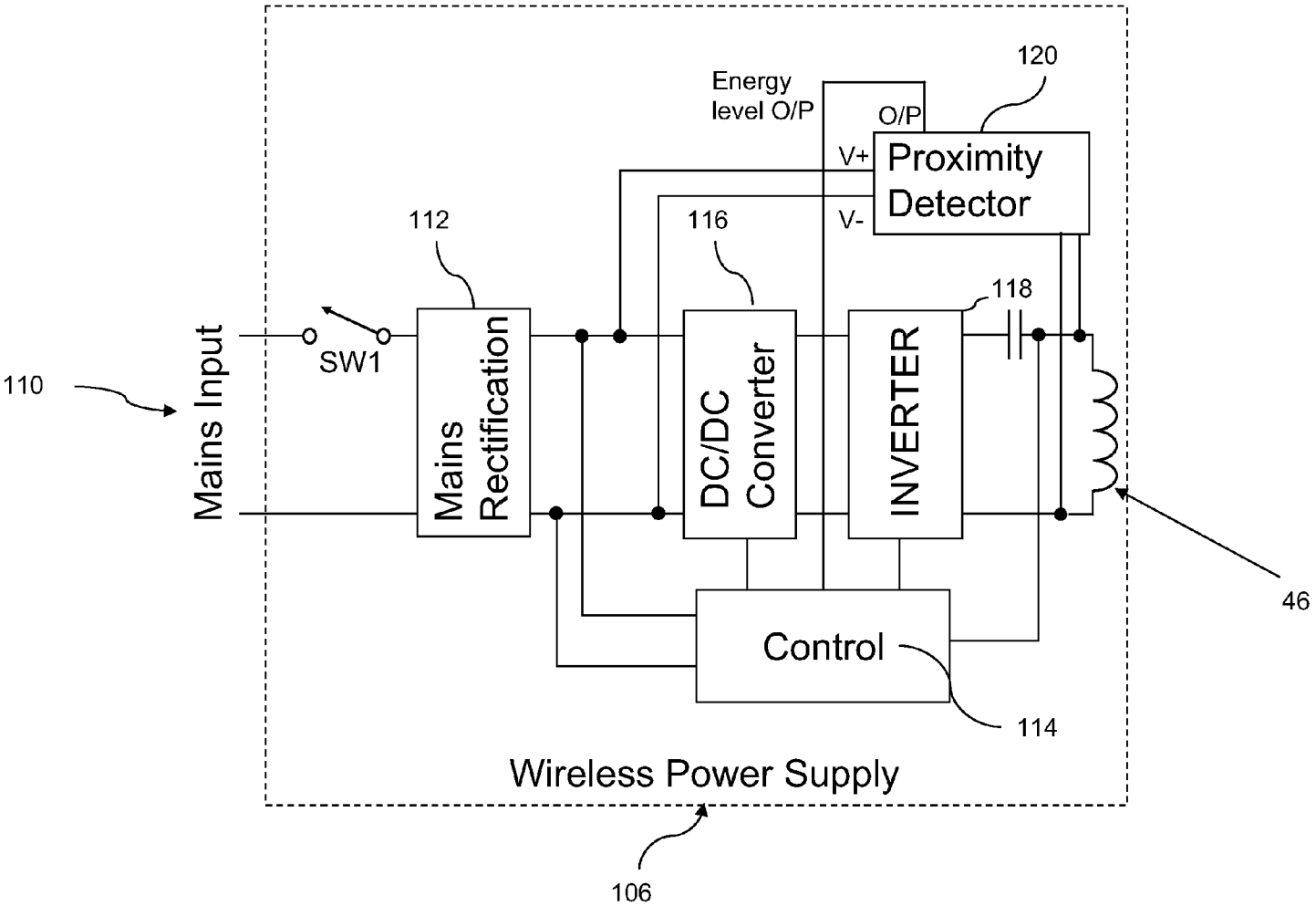
FIG. 10 discloses a circuit diagram for an inductive power track segment with proximity detector according to at least one embodiment of the present disclosure.

As also shown in FIG. 8, a wireless power supply 106 including a primary inductive coil 46 is shown embedded in a track segment 42. An inverter 96 is shown connected to the primary coil 46, as well as a microcontroller 98, which, in the current embodiment, receives signals from the sense circuit 100 to activate when the race car 60 is in proximity to the track segment 42. A DC/DC converter 102 is connected to the inverter 96 and microcontroller 98 and receives power from a DC input 104. As shown in FIG. 9, the sense circuit 100 can be an inductive sense circuit 108. Power is supplied by mains input 110, which is then rectified by mains rectifier 112. The inductive sense circuit 108 monitors the impedance of the primary coil 46 and generates a signal which is analyzed by the control unit 114 to determine if a vehicle 40, for example a race car 60, is in the proximity of the primary coil 46. The inductive sense circuit 108 may also determine the identity of the race car 60 and monitor performance. The performance information can also be used to monitor lap counts and race status, for example. Rectified power is sent through the DC/DC converter 116 and the inverter 118 which energizes the inductive coil 68 if a race car 60 is in proximity. In another embodiment as shown in FIG. 10, the sense circuit 100 can be a vehicle proximity sense circuit or proximity detector 120. By using a proximity detector 120, energy is conserved by only energizing the primary coil 46 within the track segment 42 when a race car 60 is in proximity, e.g., when the race car 60 traverses the track segment 42. Additionally, the activating of the proximity detector 120 may be used to record laps or other performance data due to the unique identification of each vehicle. Power is supplied by mains input 110, which is then rectified by the mains rectifier 112. The proximity detector 120 determines if a vehicle is in proximity and generates a signal which is analyzed by the control unit 114. Rectified power is sent through the DC/DC converter 116 and the inverter 118 which energizes the primary inductive coil 46 if a vehicle is in proximity.

Figure 11:
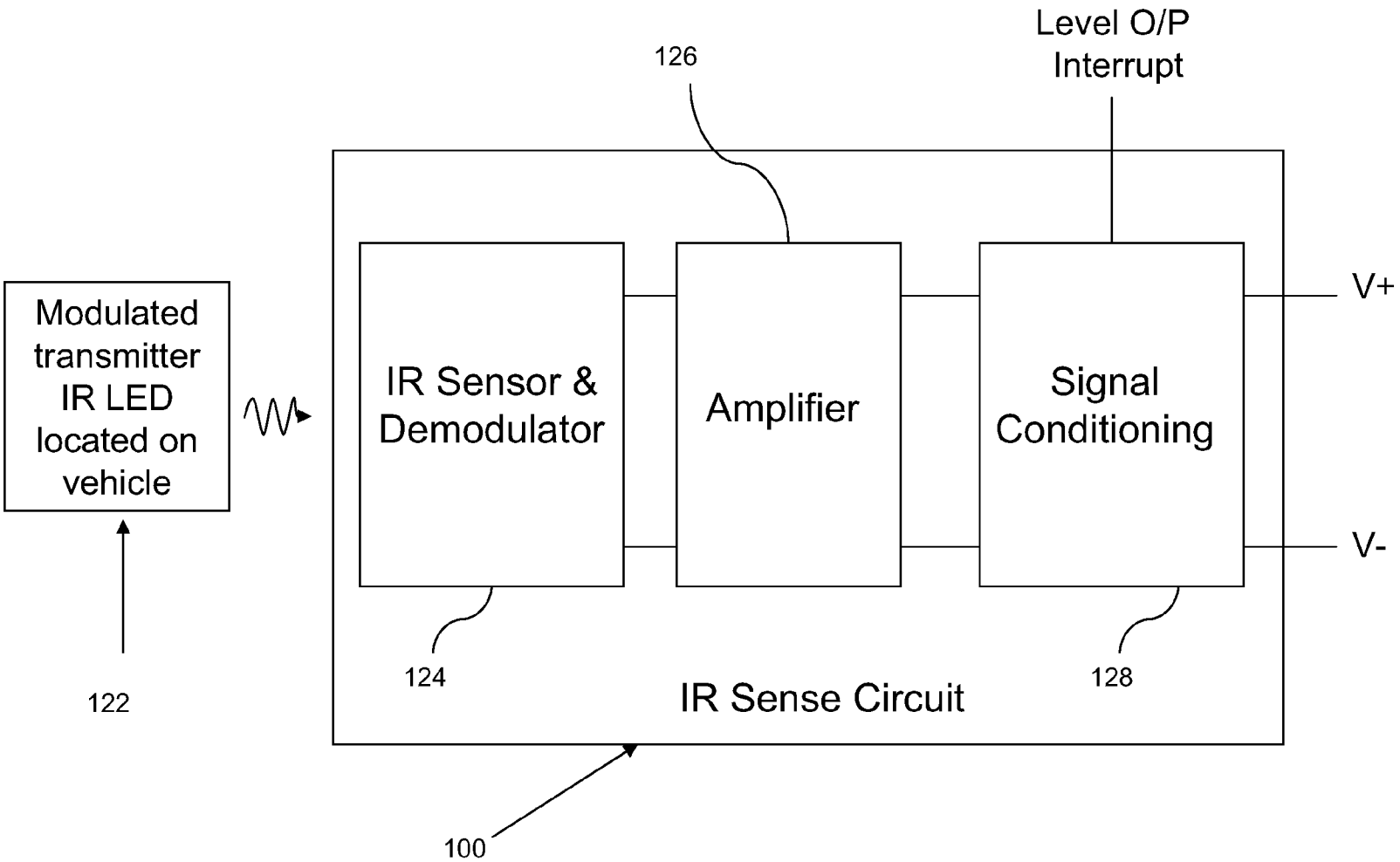
FIG. 11 discloses a circuit diagram for the inductive power track section with sense circuit using infrared (IR) modulation according to at least one embodiment of the present disclosure.

FIG. 11 is a block diagram of one embodiment of a sense circuit 100 using IR or wireless modulation, such as shown in FIG. 8. An IR or other wireless transmitter 122 is located on a race car 60, which transmits a signal to the sense circuit 100. An IR or wireless sensor and demodulator 124 receives the signal, which is amplified by amplifier 126 before being sent to signal conditioner 128, which sends an output signal to the control unit (not shown) and receives power from the rectifier (not shown). Each race car 60 may be equipped with an IR transmitter or other wireless transmitter 122 which emits an encoded unique signal which is detected when the car 60 is present near the sense circuit 100, such as may be located in a primary inductive coil track segment 56. Information encoded on the transmitted signal is used to identify the car, its performance, or other information. Additionally, optical sensors such as photoelectric eyes may also be used.

Figure 12:
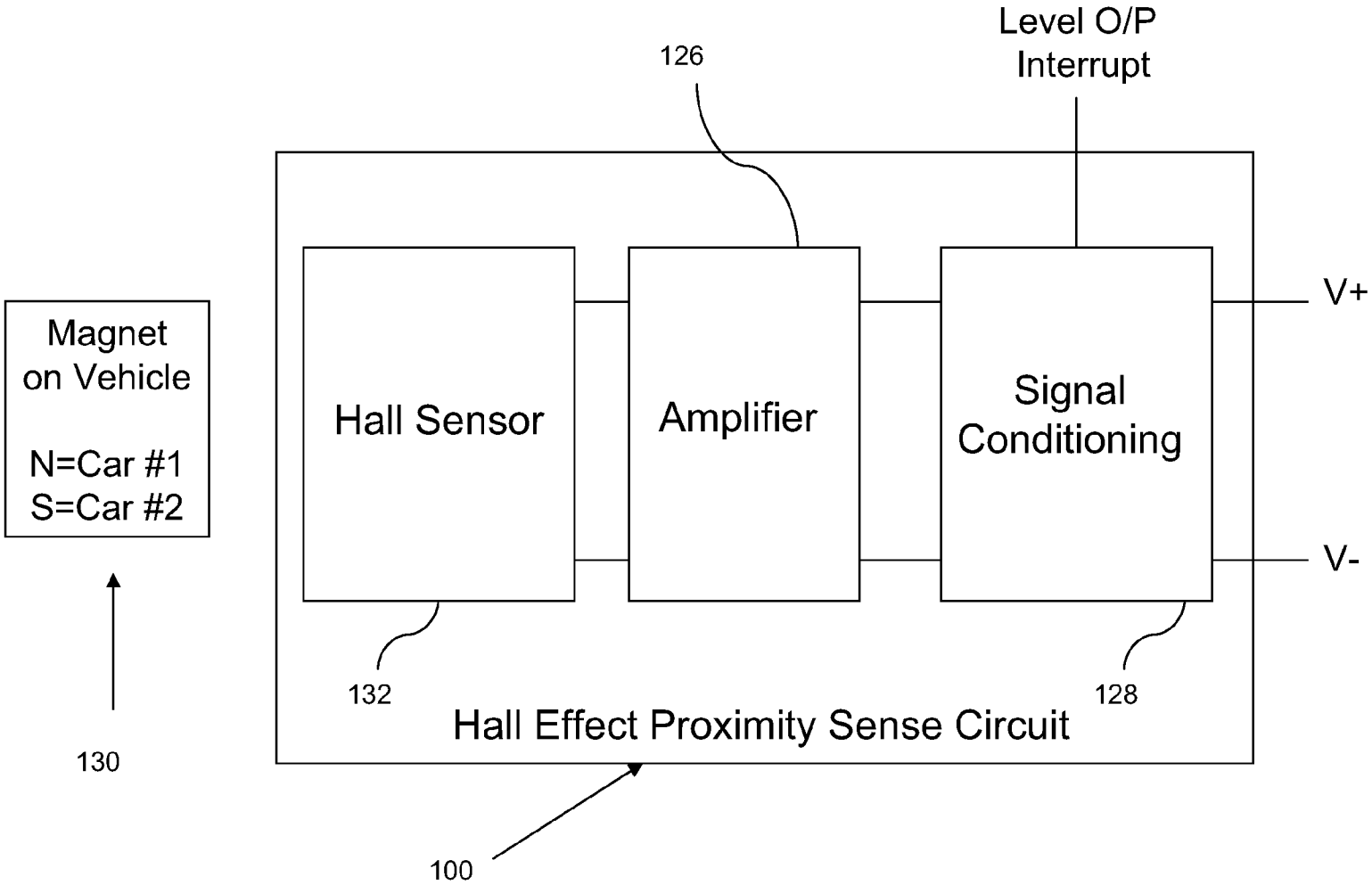
FIG. 12 discloses a circuit diagram for the present disclosure including a sense circuit using a magnetic interaction and a Hall Effect sensor according to at least one embodiment of the present disclosure.

FIG. 12 is a block diagram of one embodiment of a Hall Effect proximity sense circuit 100 such as shown in FIG. 8. A magnet 130 is located on each race car 60. The Hall Effect sensor 132 differentiates between particular cars based on the unique magnetic signal of each magnet 130 onboard each car. An arrangement of different sizes and polar orientations of the magnets 130 allows for multitudes of combinations for car identification. The signal generated by the Hall Effect sensor 132 enters the amplifier 126 before being passed to the signal conditioner 128, which outputs the signal to the control unit (not shown) and receives power from the rectifier (not shown).

Figure 13:
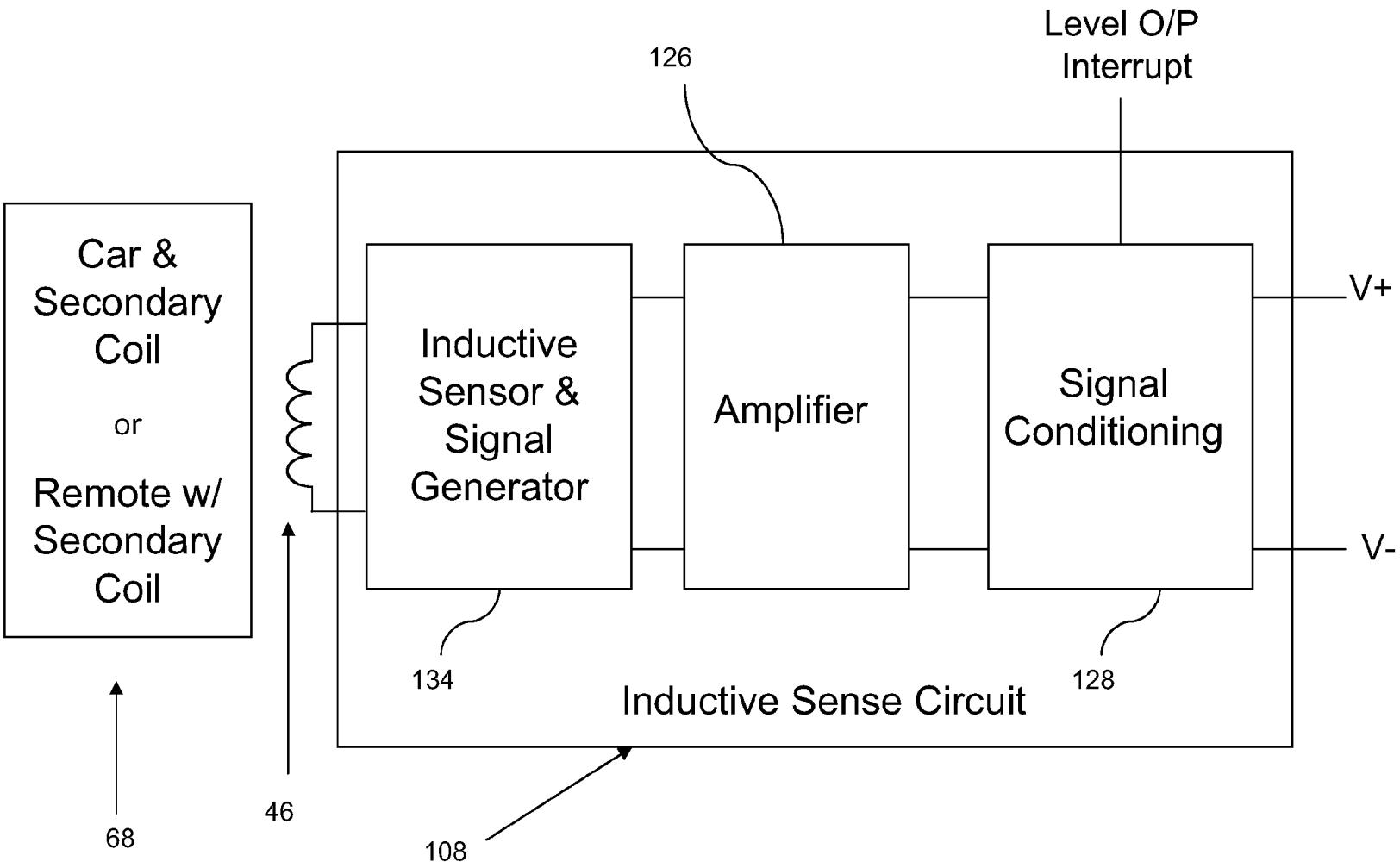
FIG. 13 discloses a circuit diagram for the sense circuit using inductive coupling to determine a toy vehicle position near the primary charging coil according to at least one embodiment of the present disclosure.

FIG. 13 is a block diagram of an inductive sense circuit 108 showing a race car 60 or remote control 76, either of which being equipped with a secondary inductive coil 68 in proximity to the primary coil 46. The primary coil 46 may be located in a track segment 42 or other suitable location, such as a charging station or holster, or a pit garage location. The inductive sensor and signal generator 134 detects the presence of a load 68 in proximity to the primary coil 46, optionally based on a change the detected impedance of the primary coil when the car 60 is proximate the inductive track segment 56, and sends a signal to the amplifier 126, which then passes the amplified signal to the signal conditioner 128 for output to the control unit (not shown) as the sense circuit 108 continues to receive power from the rectifier (not shown).

Figure 14:
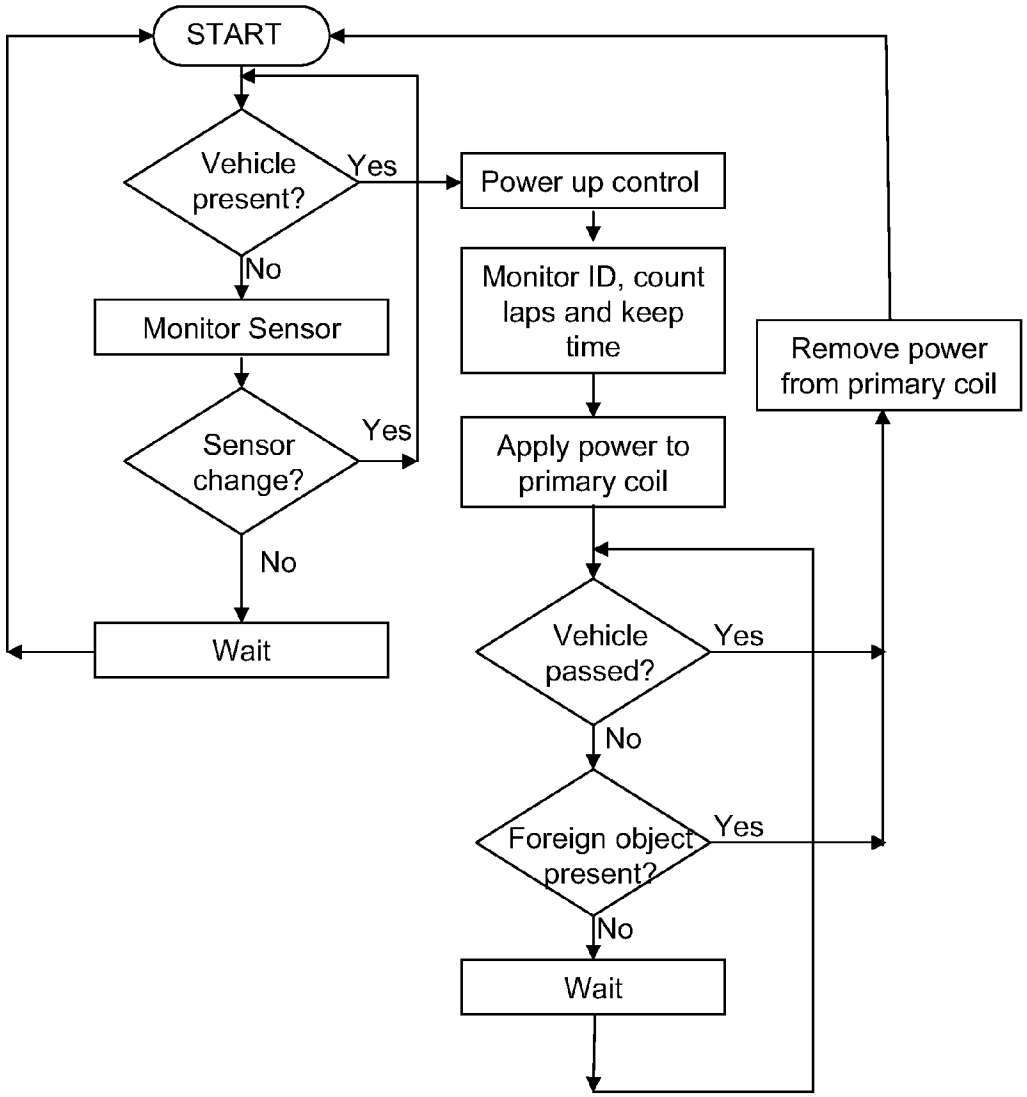
FIG. 14 discloses a process flow diagram for enabling and disabling the charging circuit.

FIG. 14 illustrates a process flow diagram describing one embodiment of a race car or remote charge sequence. The primary coil 46 with sensor unit 100, such as enclosed within a track section 42, determines whether a car 60 is present, using a motion sensor 120 or inductive sense circuit 108. If no car is present, the primary coil 46 remains de-energized. If a car or remote is present, however, the control unit is powered up, which using sensors determines the car identity, speed, and other data, and transmits the data to the power and race control unit 58. Power is then applied to the primary coil 46 for the period the car 60 is present. Once the race car 60 has passed out of the presence of the primary coil 46, or a foreign object is detected, the primary coil 46 is de-energized until another race car 60 enters the proximity of the primary coil 46. Accordingly, the primary coil 46 provides wireless power to the car 60 in increments corresponding to successive traversals of the inductive charging segment 56 by the race car.

Figure 15:
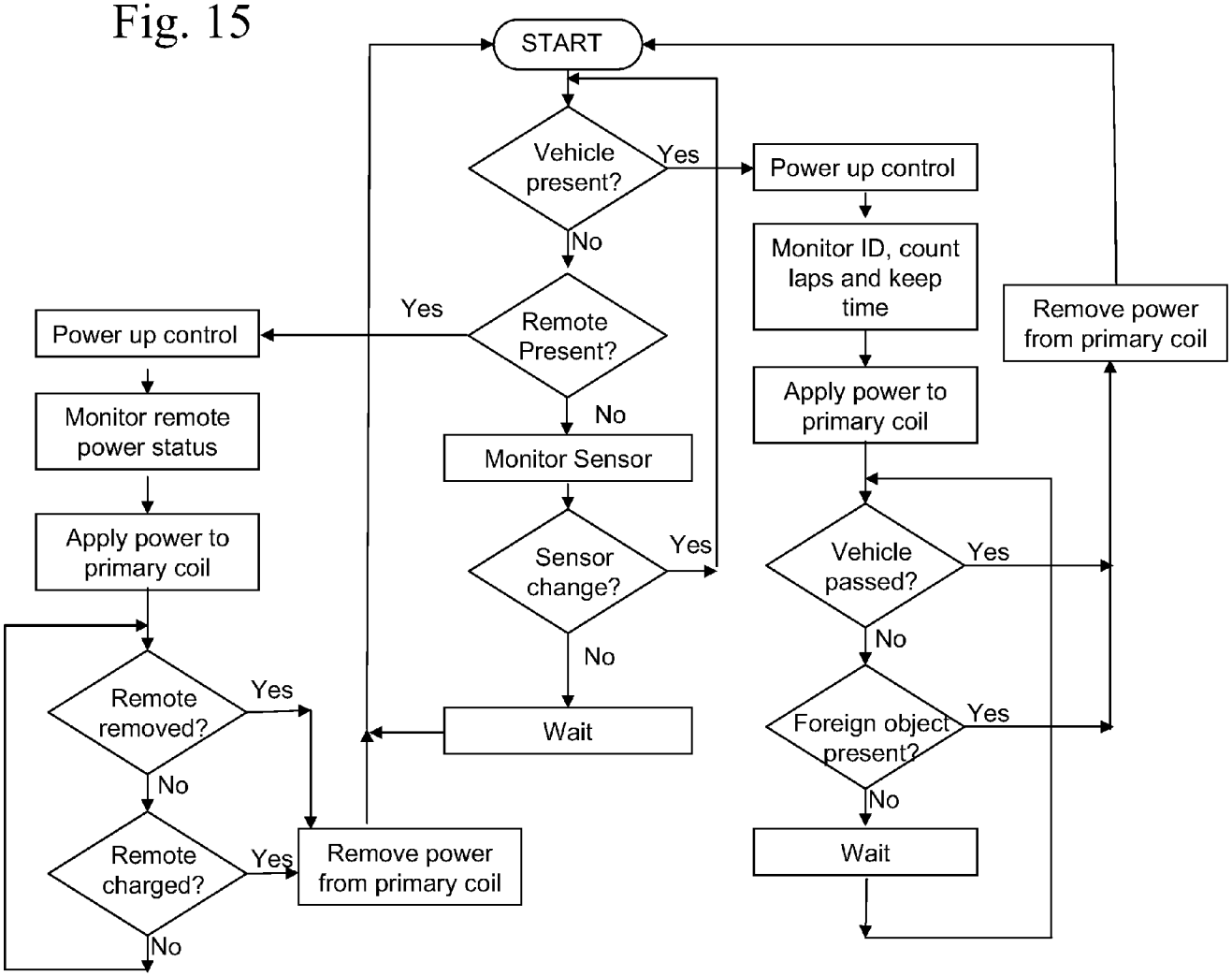
FIG. 15 discloses a process flow diagram for charging a car or a remote control on a segment of track equipped with a primary inductive coil according to at least one embodiment of the present disclosure.

FIG. 15 is a process flow diagram describing another embodiment of a race car or remote charge sequence. The primary coil 46 with sensor unit 100, such as enclosed within a track section 42, determines whether a car 60 or remote control is present, using a motion sensor 120 or inductive sense circuit 108. If no car 60 or remote 76 is present, the primary coil 46 remains de-energized. If a car 60 or remote 76 is present, however, the control unit 114 is powered up, which using sensors determines the car identity, speed, and other data, and transmits the data to the power and race control unit 58. Power is then applied to the primary coil 46 for the period the car 60 or remote 76 is present. Once the race car 60 has passed out of the presence of the primary coil 46, the remote 76 is removed, or a foreign object is detected, the primary coil 46 is de-energized until another race car 60 or remote 76 enters the proximity of the primary coil 46, or until the foreign object is removed. Accordingly, the primary coil 46 provides wireless power to the car 60 in increments corresponding to successive traversals of the inductive charging segment 56 by the race car.

Figure 16:
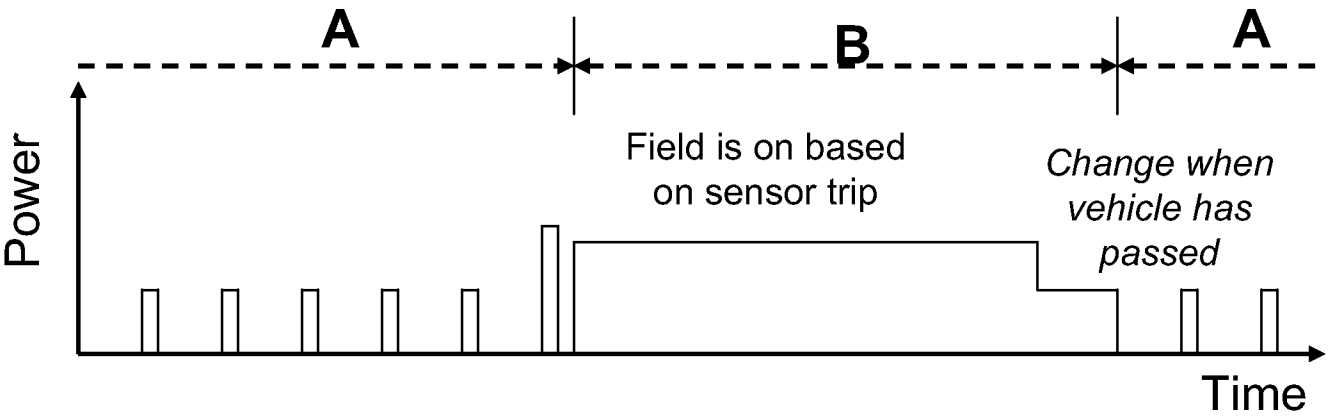
FIG. 16 discloses a sensor sequence using an inductive sensor to turn power on and off in a primary inductive coil track segment according to at least one embodiment of the present disclosure.

FIG. 16 is a graph of one embodiment of a sensor sequence using an inductive sensor to energize and de-energize a primary inductor coil. In section A, the inductive sensor 134 periodically checks for the presence of a race car 60. As the car 60 enters the range of the sensor 134, the inductive sensor 134 detects the presence of a load 68 and activates the primary coil 46, energizing it to provide power to the race car 60. Once the race car 60 has passed out of the range of the inductive sensor 134, the primary coil 46 is deactivated and the inductive sensor 134 returns to a periodic checking mode, until the next race car 60 enters the range of the inductive sensor 134.

Figure 17:
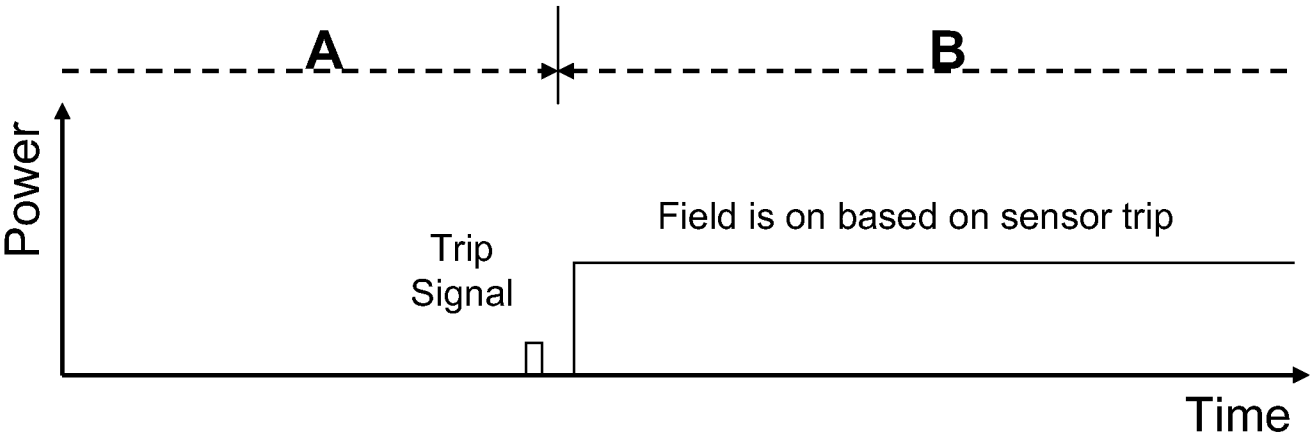
FIG. 17 discloses a sensor sequence using light, IR or magnetic sensors to turn power in the track segment primary coil according to at least one embodiment of the present disclosure.

FIG. 17 is a graph of one embodiment of a sensor sequence with using various sensing techniques, including light, IR, magnetic sensors, or other wireless communication. As a race car approaches a sensor, it is wirelessly detected, and the sensor signal is communicated to the control unit which energizes the primary coil located in a track segment, for example. The sensor continues to detect the presence of the car, and maintains the signal sent to the control unit.

Figure 18:
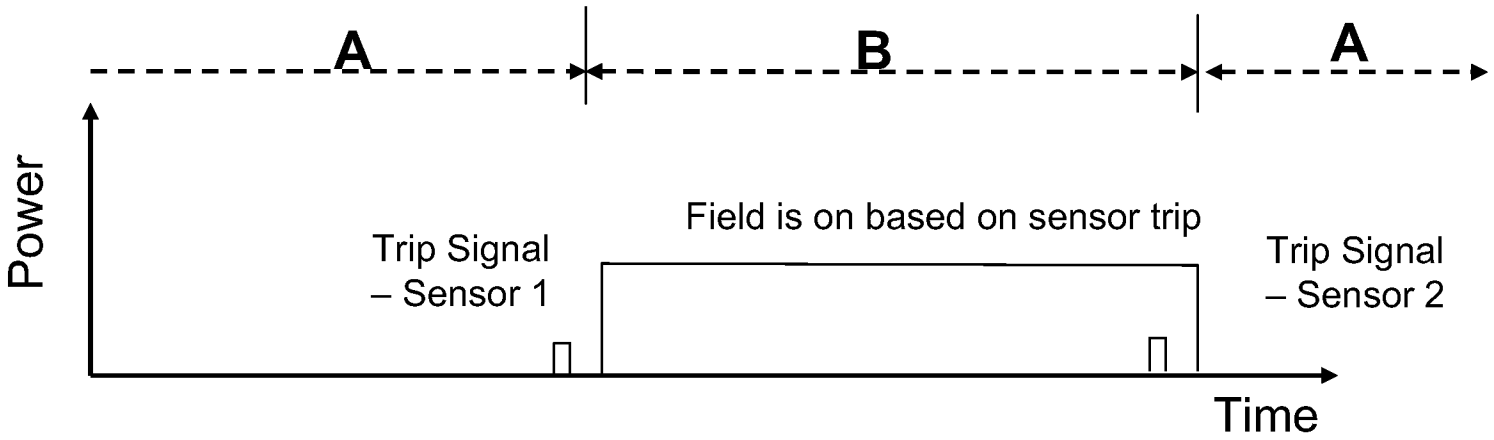
FIG. 18 discloses a sensor sequence using light, IR, or magnetic sensors to turn power on or off in the track segment primary coil according to at least one embodiment of the present disclosure.

FIG. 18 is a graph of one embodiment of a sensor sequence with using various sensing techniques, including light, IR, magnetic sensors, or other wireless communication. As a race car approaches a sensor, it is wirelessly detected, and the sensor signal is communicated to the control unit which energizes the primary coil located in a track segment, for example. The sensor continues to detect the presence of the car, and maintains the signal sent to the control unit. After a period of time, the car departs the range of the sensor, and primary coil is de-energized.

Figure 19:
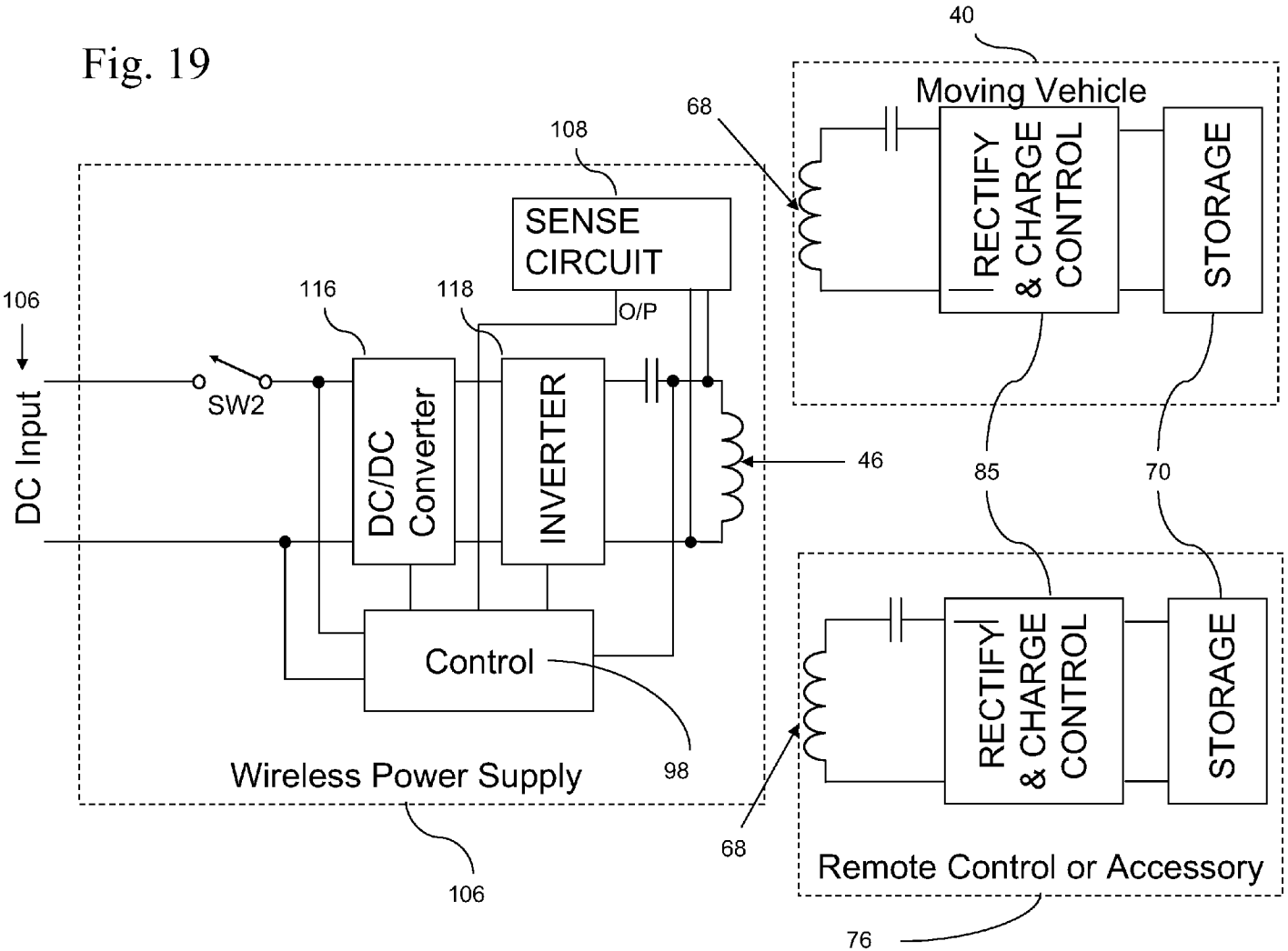
FIG. 19 discloses a diagram of the interoperability between the toy vehicle and the remote controller, whereby the energy storage in both are inductively charged according to at least one embodiment of the present disclosure.
Figure 20:
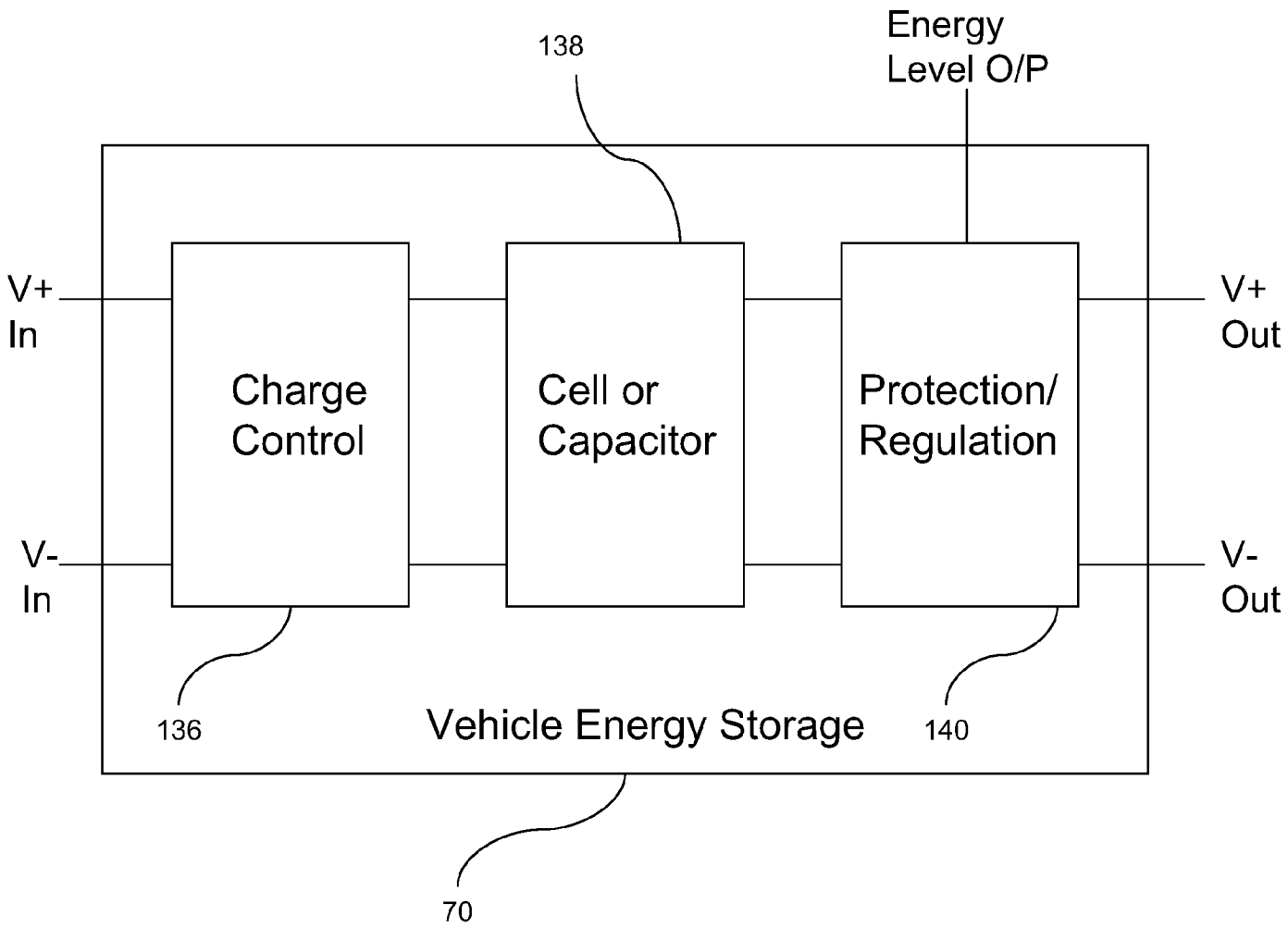
FIG. 20 discloses a diagram for the charging and energy storage system inside the toy vehicle according to at least one embodiment of the present disclosure.
Figure 21:
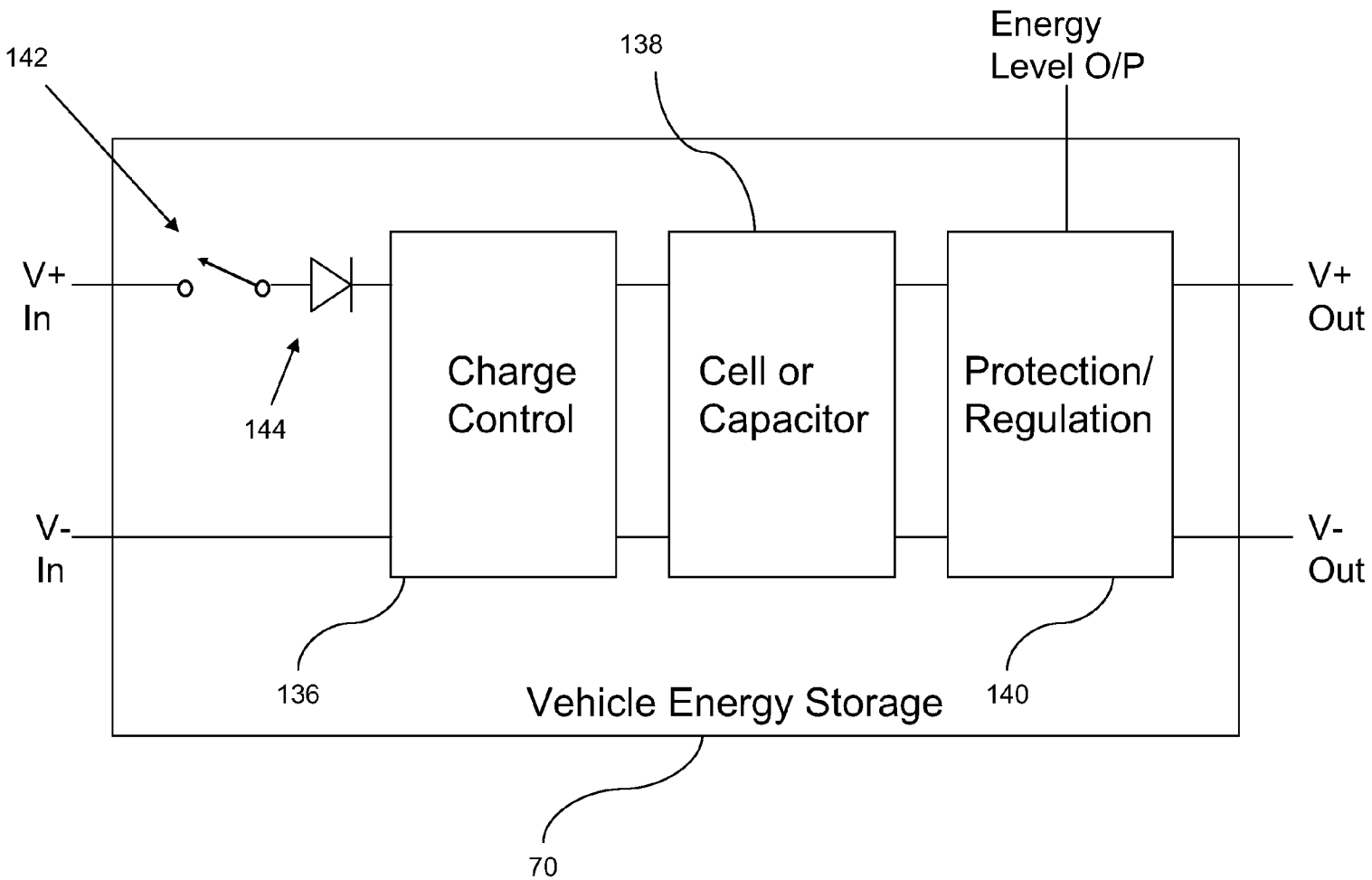
FIG. 21 discloses a circuit diagram for the charging and energy storage system inside the toy vehicle including a protection switch and a diode according to at least one embodiment of the present disclosure.

FIG. 19 is a block diagram illustrating the interoperability of an inductive wireless power supply 106, a toy vehicle 40, and a vehicle controller 76. As described above in connection with FIG. 14, the wireless power supply 106 can include a DC/DC converter 116 connected to an inverter 118 and microcontroller 98 and receives power from a DC input 104. The wireless power supply 106 is shown as including an inductive sense circuit 108, but can also include a proximity detector 120 as explained above in connection with FIG. 10. The toy vehicle 40 and remote control 76 can each include an inductive secondary 68, a rectify and charge control circuit 85 as described above in connection with FIG. 9, and a vehicle energy storage unit 70. In operation, the wireless power supply 106 provides a varying magnetic field to induce an alternating current in the respective secondary coils 68 of the toy vehicle 40 and remote control 76. Once rectified by the rectifier and charge control circuit 85, current supplied by the secondary coil can be stored in the energy storage unit 70. As shown in FIG. 20, the vehicle energy storage device can include a charge control unit 136, a storage device 138 and a protection/regulation device 140. The storage device 138 can include a battery, capacitor, combination of both, or other storage device. The voltage is conditioned to the appropriate values for the subsequent circuit elements in the protection/regulation device 140. Output signals are produced by the protection/regulation device 140 which indicate the charge state of storage device 138 and are sent to the car control unit (not shown). As shown in FIG. 21, the vehicle energy storage unit 70 includes a protection switch 142 and diode 144 after the voltage input point. The switch 142 allows for the isolation of the energy storage circuit 70 if so desired and the diode 144 constrains flow only into the charge control circuit block.

Figure 22:
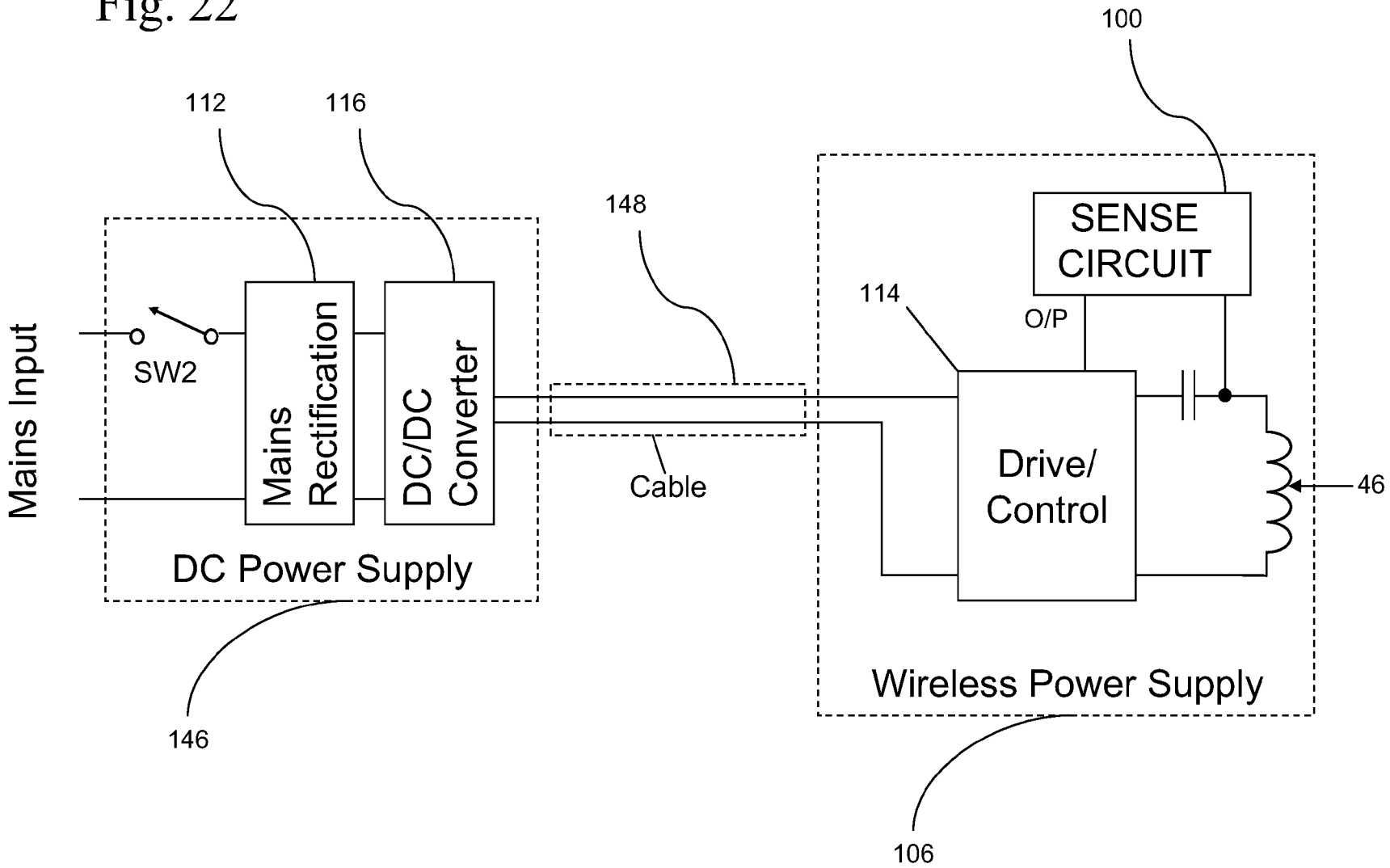
FIG. 22 discloses a circuit diagram showing AC mains power being transformed and rectified to provide DC power to the wireless power supply to at least one embodiment of the present disclosure.

FIG. 22 is one embodiment of a circuit diagram of AC mains power being transformed and rectified in the DC power supply 146, which using a cable 148, can be remotely located from the wireless race track power supply 106, allowing for large track circuits and freedom from mains power outlet locations.

Figure 23:
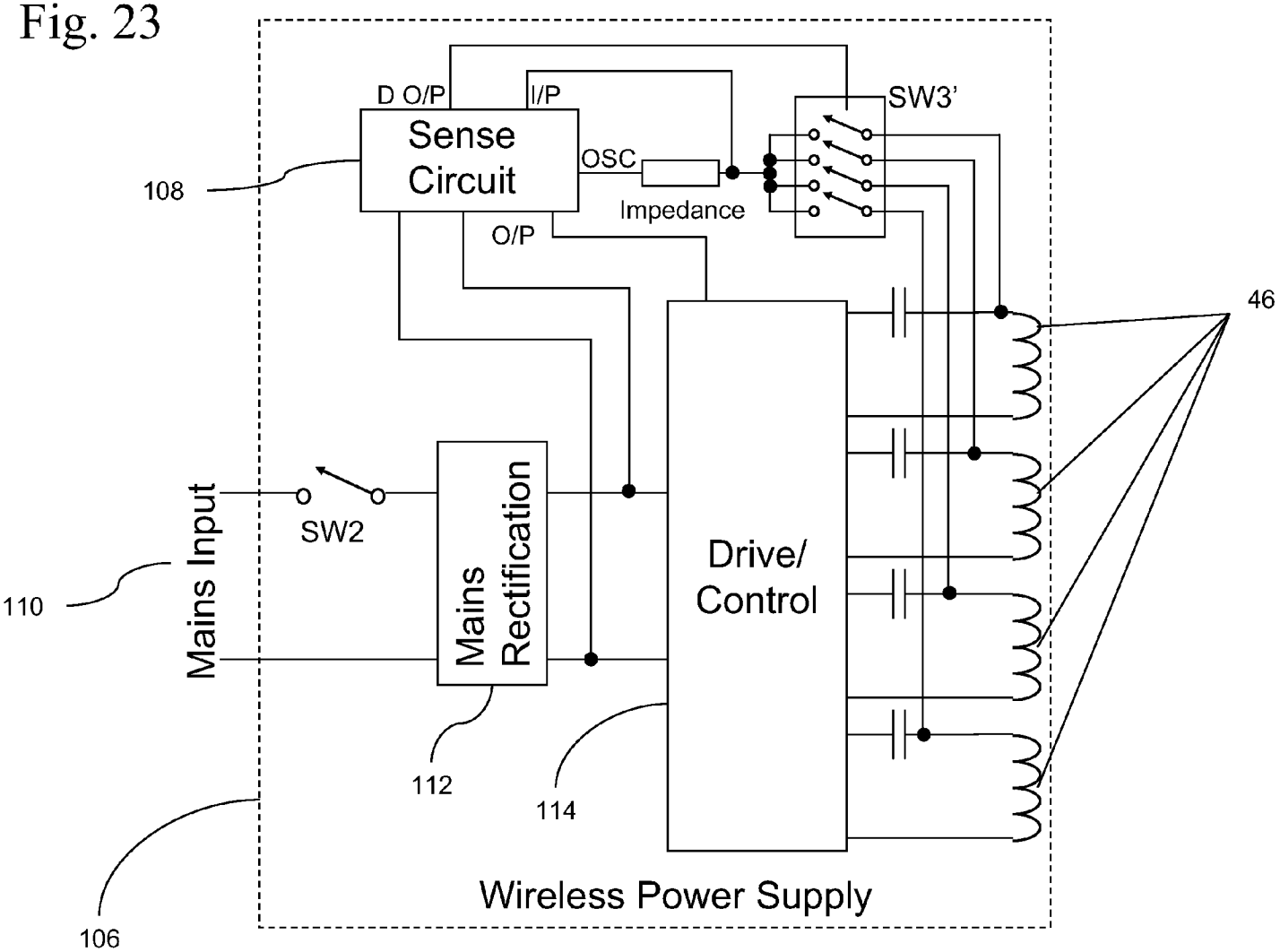
FIG. 23 discloses a circuit diagram illustrating multiple track segments with primary inductive coils that are monitored by a drive controller according to at least one embodiment of the present disclosure.

FIG. 23 is one embodiment of a circuit diagram illustrating multiple inductive track segments 56 being monitored, powered and controlled by a single drive controller 114. Mains voltage 110 is supplied to the wireless power supply 106. As the voltage enters the power supply, it first passes to the rectifier 112, after which the sense circuit 100 monitors the presence of race cars (or other secondary coil-equipped devices) at multiple track segments. A single drive control unit 114 is connected to the multiple track segments, each with its own primary coil 46. As race cars enter the proximity of the various coils, the sense circuit detects their load and allows for power to the supplied to the particular coil where a car is present, for the period that the car is present.

Figure 24:
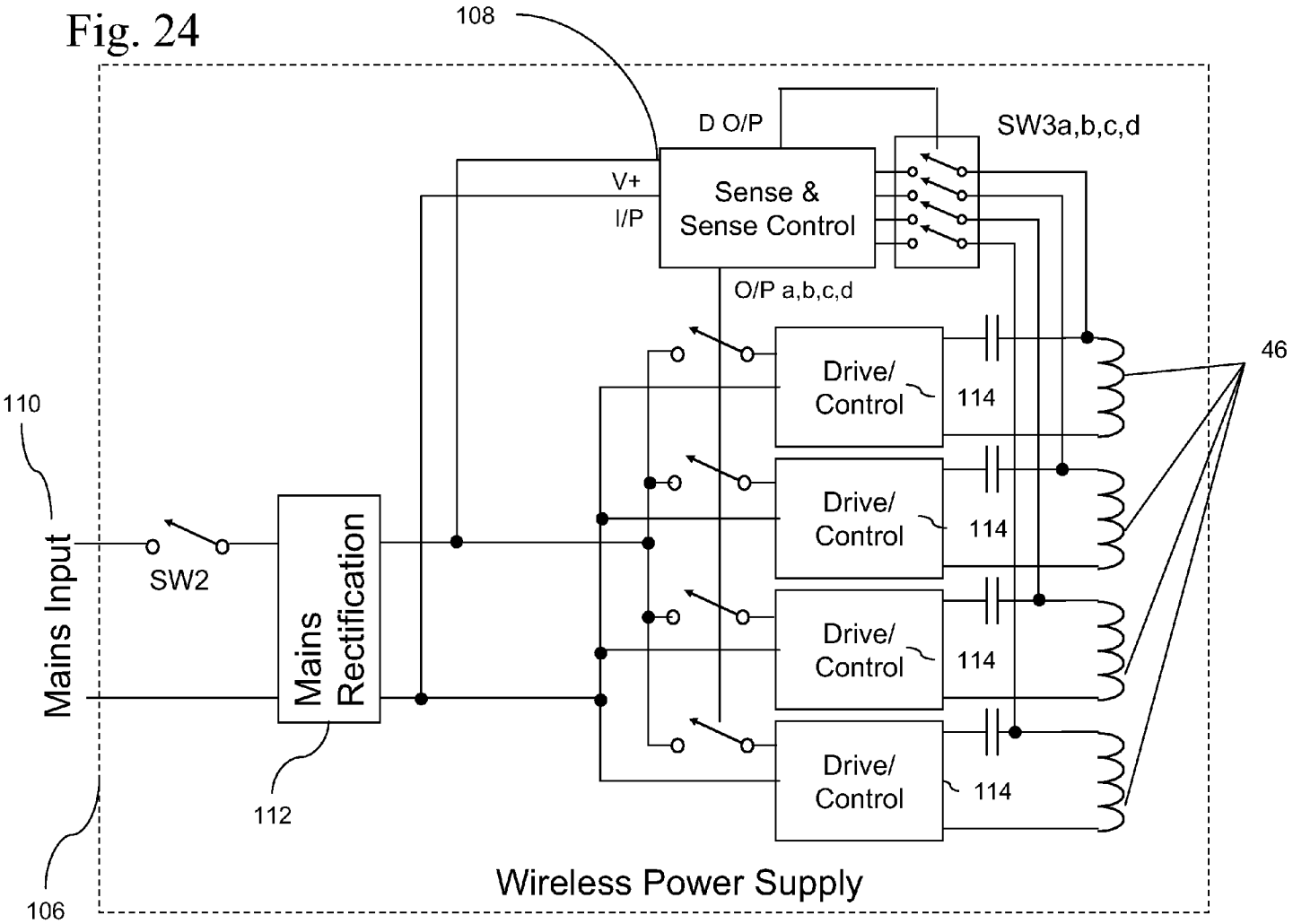
FIG. 24 discloses a circuit diagram illustrating multiple track segments with primary inductive coils that are monitored by multiple drive controllers according to at least one embodiment of the present disclosure.

FIG. 24 is a circuit diagram illustrating multiple inductive track segments 56 being monitored, powered and controlled by multiple drive controllers 114. Mains voltage 110 is supplied to the wireless power supply 106. As the power enters the power supply, it first passes to the rectifier 112, after which the sense circuit 100 monitors the presence of race cars (or other secondary coil-equipped devices) at multiple track segments. Multiple drive control units 114 are connected to the multiple track segments, each with its own primary coil 46. As race cars enter the proximity of the various coils, the sense circuit detects their load and allows for power to the supplied to the particular coil where a car is present, for the period that the car is present.

Figure 25:
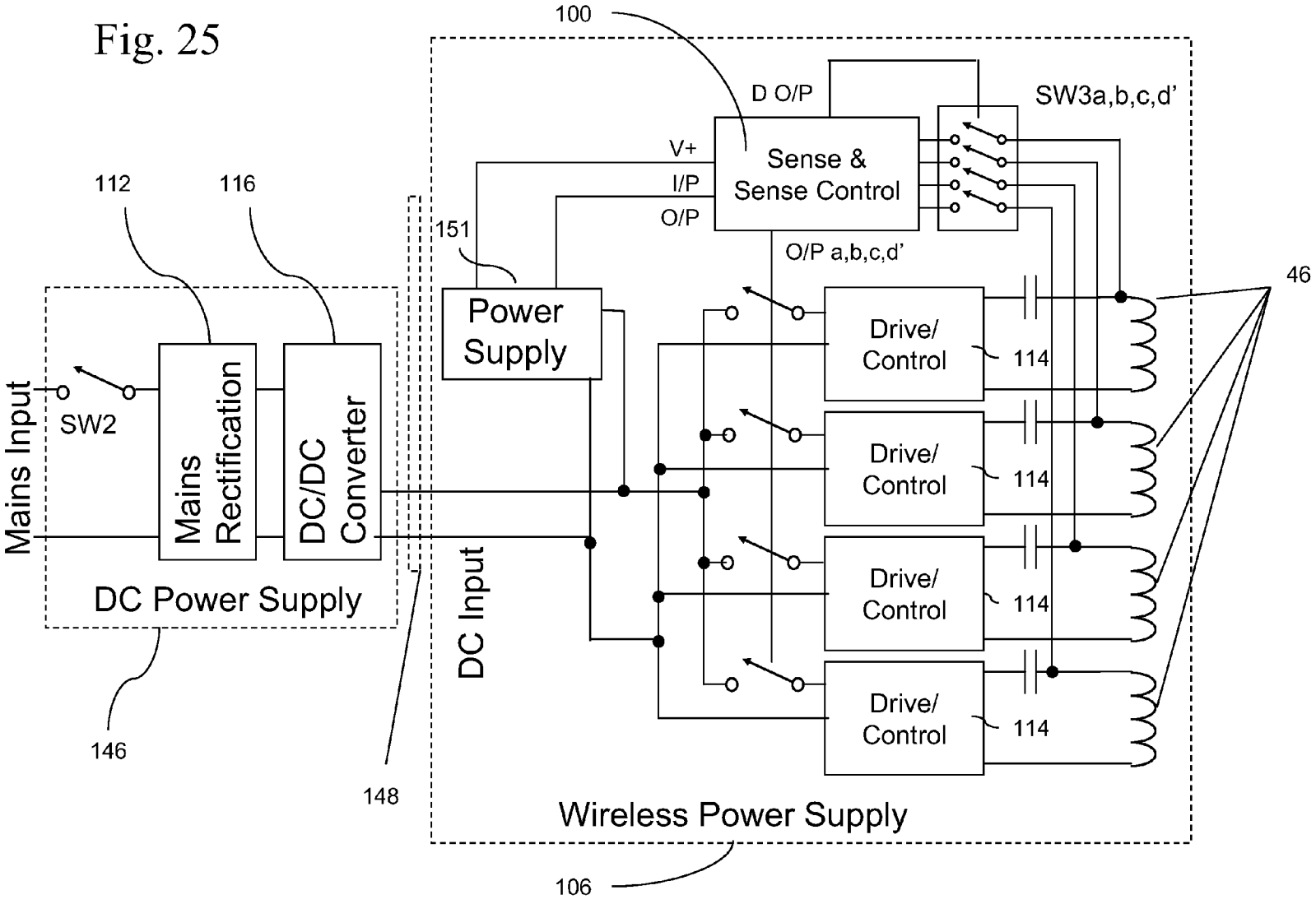
FIG. 25 discloses a circuit diagram illustrating AC mains power being transformed and rectified to power multiple segments of track containing primary inductive coils according to at least one embodiment of the present disclosure.

FIG. 25 is a circuit diagram illustrating mains power being transformed and rectified to power multiple inductive track segments, including the separation of the mains rectification and the DC/DC conversion from the remainder of the race track using a cable. Mains voltage is supplied to the DC power supply 146, containing a rectifier and a DC/DC converter. Connected to the DC power supply is cable 148, which allows for separation of the DC power supply and the wireless power supply 106, which includes an internal power supply 150, connected to a sense and sense control unit 100, which monitors the presence of race cars (or other secondary coil-equipped devices) at multiple track segments. Multiple drive control units 114 are connected to the multiple track segments, each with its own primary coil 46. As the voltage enters the power supply, it first passes to the rectifier 112, after which the sense circuit 100 monitors the presence of race cars (or other secondary coil-equipped devices) at multiple track segments. Multiple drive control units 114 are connected to the multiple track segments, each with its own primary coil 46. As race cars enter the proximity of the various coils, the sense circuit detects their load and allows for power to the supplied to the particular coil where a car is present, for the period that the car is present.

Figure 26:
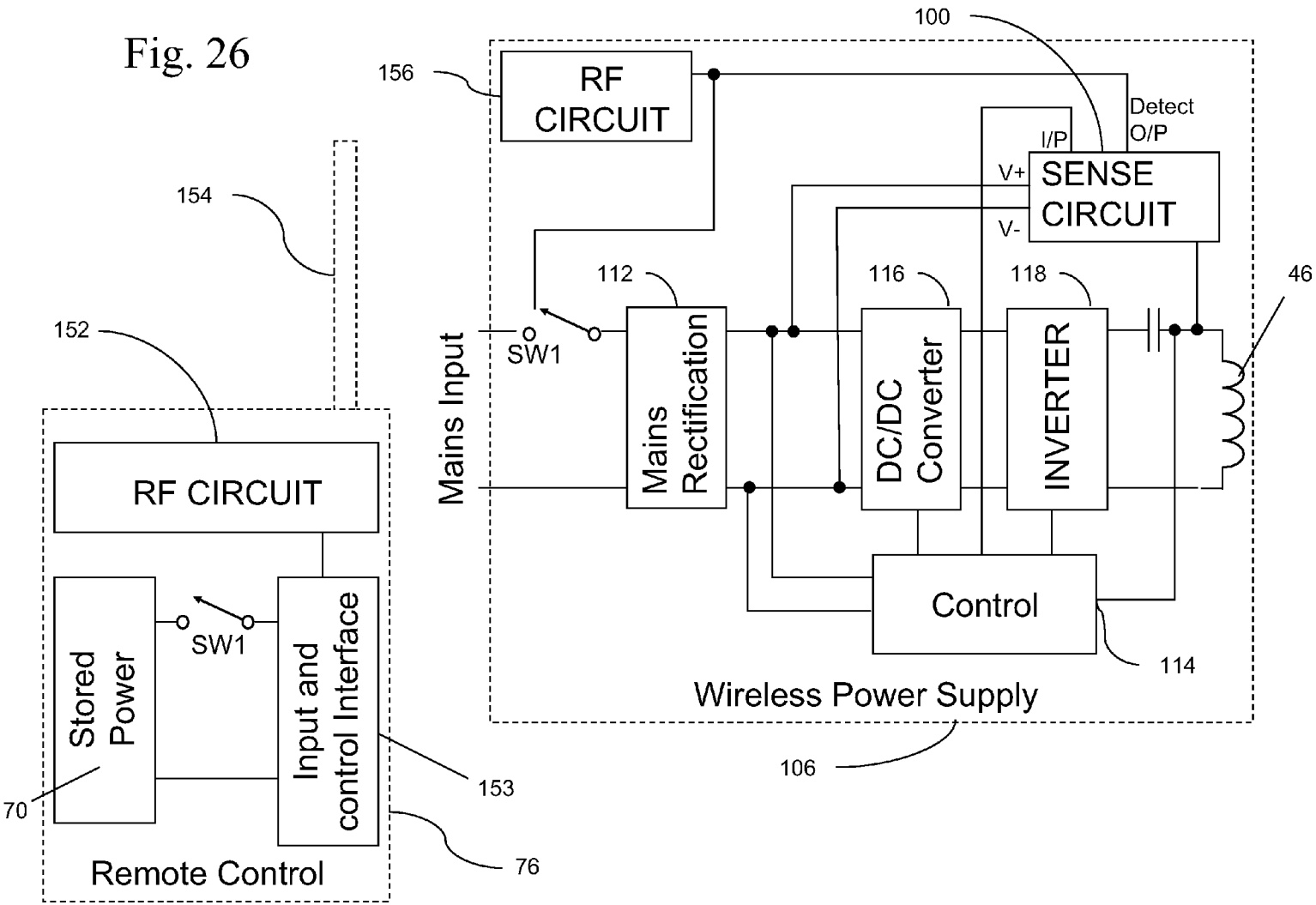
FIG. 26 discloses a circuit diagram illustrating radio frequency (RF) communication of an inductive coil equipped track segment according to at least one embodiment of the present disclosure.

FIG. 26 is a circuit diagram illustrating one embodiment of RF remote communication of the inductive segments of race track, which allows for wireless control of the power supply and communication between the components. A remote control unit 76 includes an input and control interface 153, a stored power device 70, such as a battery, and a RF or wireless circuit 152, which is connected to an optional antenna 154. The remote control unit 76 communicates with the wireless power supply 106 using RF, infrared, Bluetooth or other type of wireless communication. Mains power is supplied to the wireless power supply. There, mains power is supplied to the RF/wireless communications circuit 156, though DC power may also be used. Mains power is rectified by the rectifier 112, after which the output is monitored by the power supply control unit 114 and the sense circuit 100, which also is connected to the RF communications circuit. The DC/DC converter processes the rectified power and sends it to the inverter 118, after which the power is sent to the primary coil 46, which is located in a track segment 42 or other suitable location. The remote control 76, toy vehicle 40, or inductive track segment 56 can include a charge condition indicator (not shown) to provide an indication based on the available charge remaining in a storage device 70 in either of the remote control 76 or toy vehicle 40.

Figure 27:
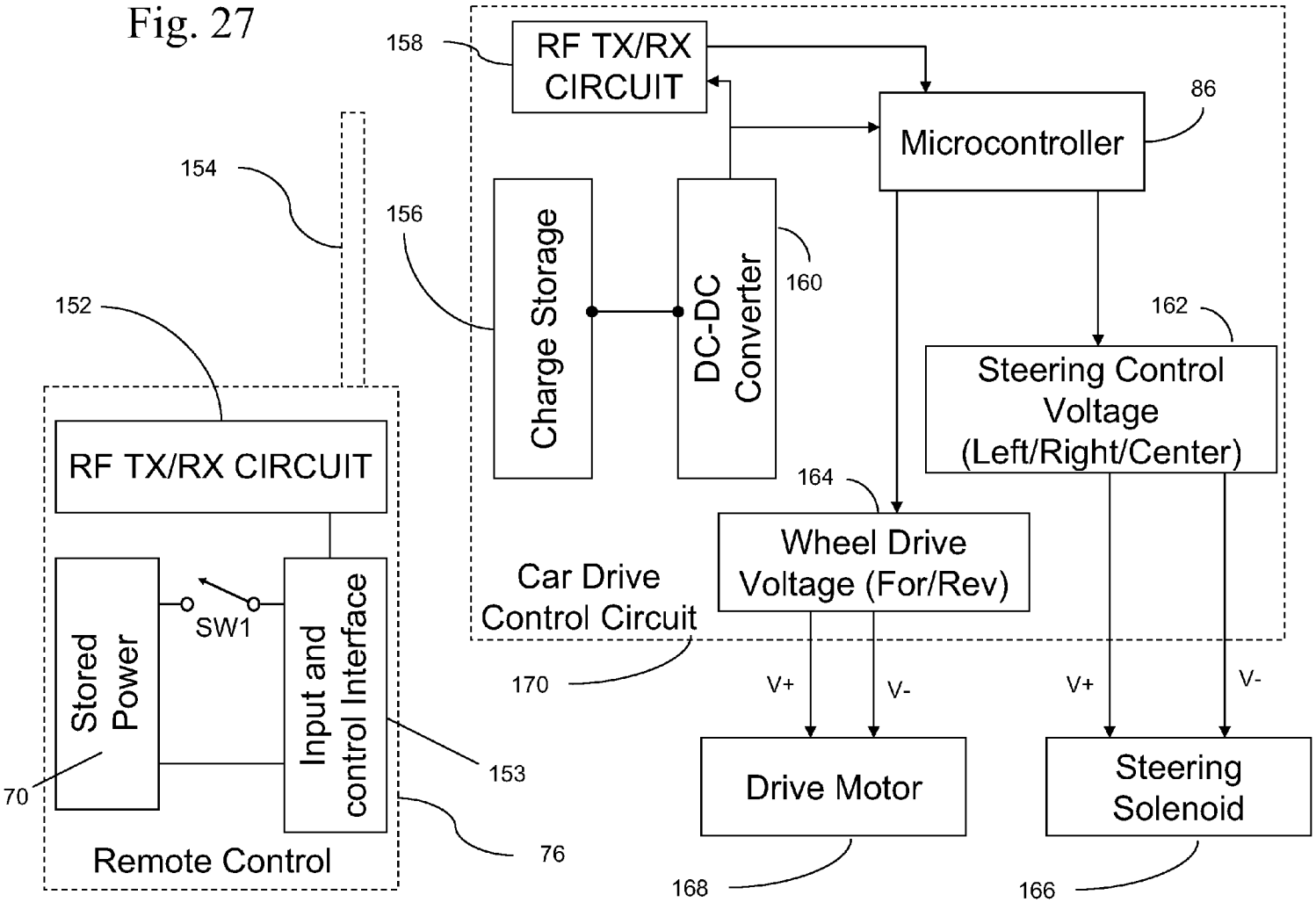
FIG. 27 discloses a circuit diagram illustrating a discrete drive and steering control of a vehicle and a remote controller according to at least one embodiment of the present disclosure.

FIG. 27 discloses a circuit diagram illustrating a discrete drive and steering control of a car and a remote controller 76. Within the controller is a RF transmit and receive circuit 152, connected to an input and control interface 153, which features operational controls, such as forward/reverse, turn right/left, and other vehicle controls. The remote controller 76 is powered by a stored power device 70, which may be a battery, a capacitor, a combination of both, or another suitable power storage device. The remote controller 76 also includes an antenna 154, which may be external or internal. The car drive control circuit 170 is located within a vehicle (not shown) and includes a charge storage device, which may be a battery, a capacitor, a combination of both, or another suitable power storage device. The charge storage device 156 is connected to a DC/DC converter 160, which provides power to the RF transmit and receive circuit 158. Signals from the circuit 158 are relayed to the microcontroller 86, which also is powered by the DC/DC converter 160. The microcontroller controls the steering control voltage unit 162 and the wheel drive voltage unit 164. The drive motor 168 receives regulated voltage from the wheel drive voltage unit resulting in varying vehicle speed according to user input on the remote controller 76. The steering solenoid 166 receives regulated voltage from the steering control voltage unit 162 resulting in varying vehicle direction according to user input on the remote controller 76. As noted above in connection with FIG. 26, the remote control 76, toy vehicle 40, or inductive track segment 56 can include a charge condition indicator (not shown) to provide an indication based on the available charge remaining in a storage device 70 in either of the remote control 76 or toy vehicle 40.

Figure 28:
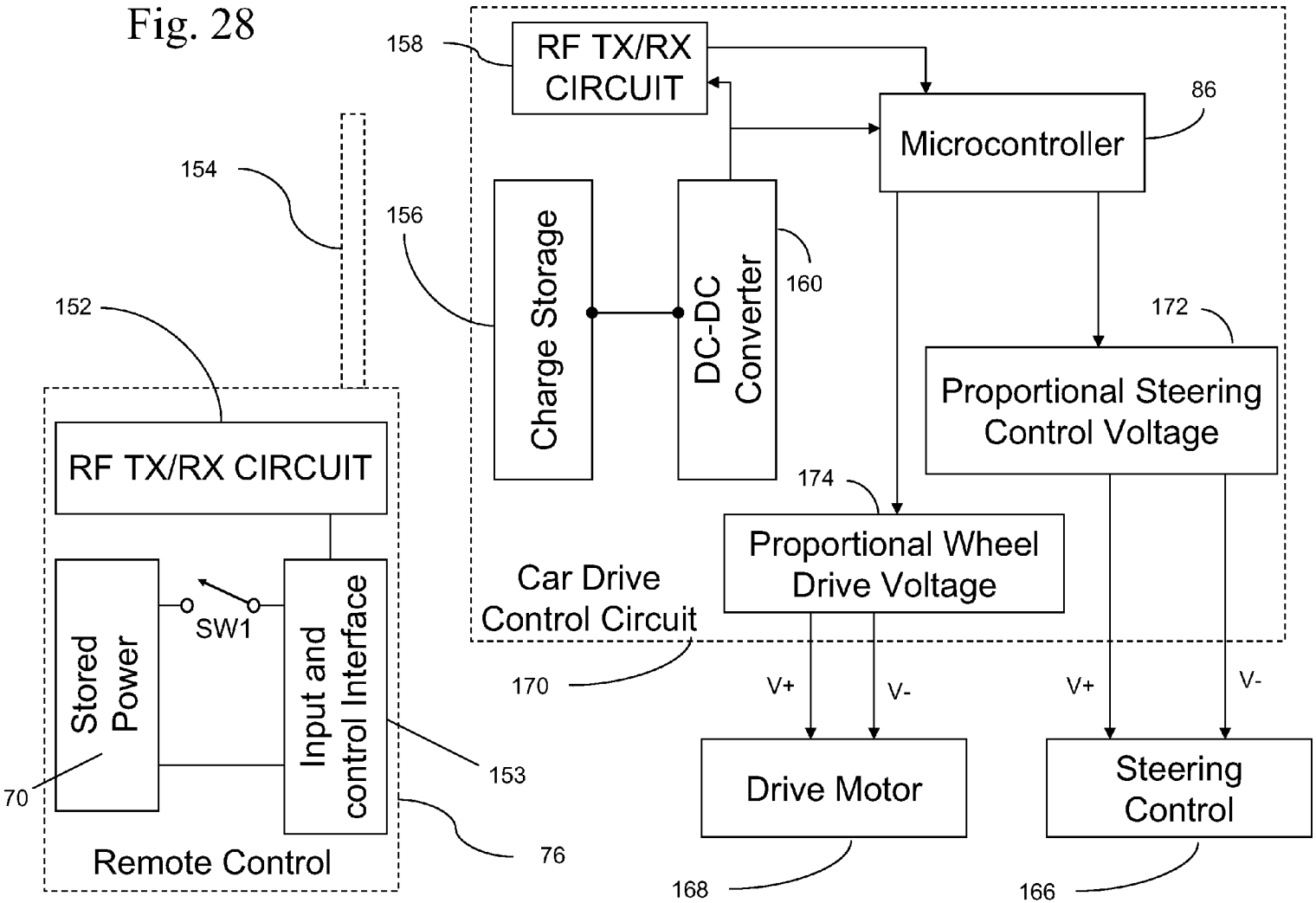
FIG. 28 discloses a circuit diagram illustrating a continuous (proportional) control of drive and steering control of a car and a remote controller according to at least one embodiment of the present disclosure.

FIG. 28 discloses a circuit diagram illustrating a continuous (proportional) control of drive and steering control of a car 60 and a remote controller 76. Within the controller is a RF transmit and receive circuit 152, connected an input and control interface 153, which features operational controls, such as forward/reverse, turn right/left, and other vehicle controls. The remote controller is powered by a stored power device 70, which may be a battery, a capacitor, a combination of both, or another suitable power storage device. The remote controller 76 also includes an antenna 154, which may be external or internal. The car drive control circuit 170 is located within a vehicle (not shown) and includes a charge storage device, which may be a battery, a capacitor, a combination of both, or another suitable power storage device. The charge storage device is connected to a DC/DC converter 160, which provides power to the RF transmit and receive circuit 158. Signals from the circuit 158 are relayed to the microcontroller 86, which also is powered by the DC/DC converter. The microcontroller controls the proportional steering control voltage unit 172 and the proportional wheel drive voltage unit 174. The drive motor 168 receives regulated voltage from the wheel drive voltage unit resulting in varying vehicle speed according to user input on the remote controller 76. The steering solenoid 166 receives regulated voltage from the proportional steering control voltage unit 172 resulting in varying vehicle direction according to user input on the remote controller 76.

Figure 29:
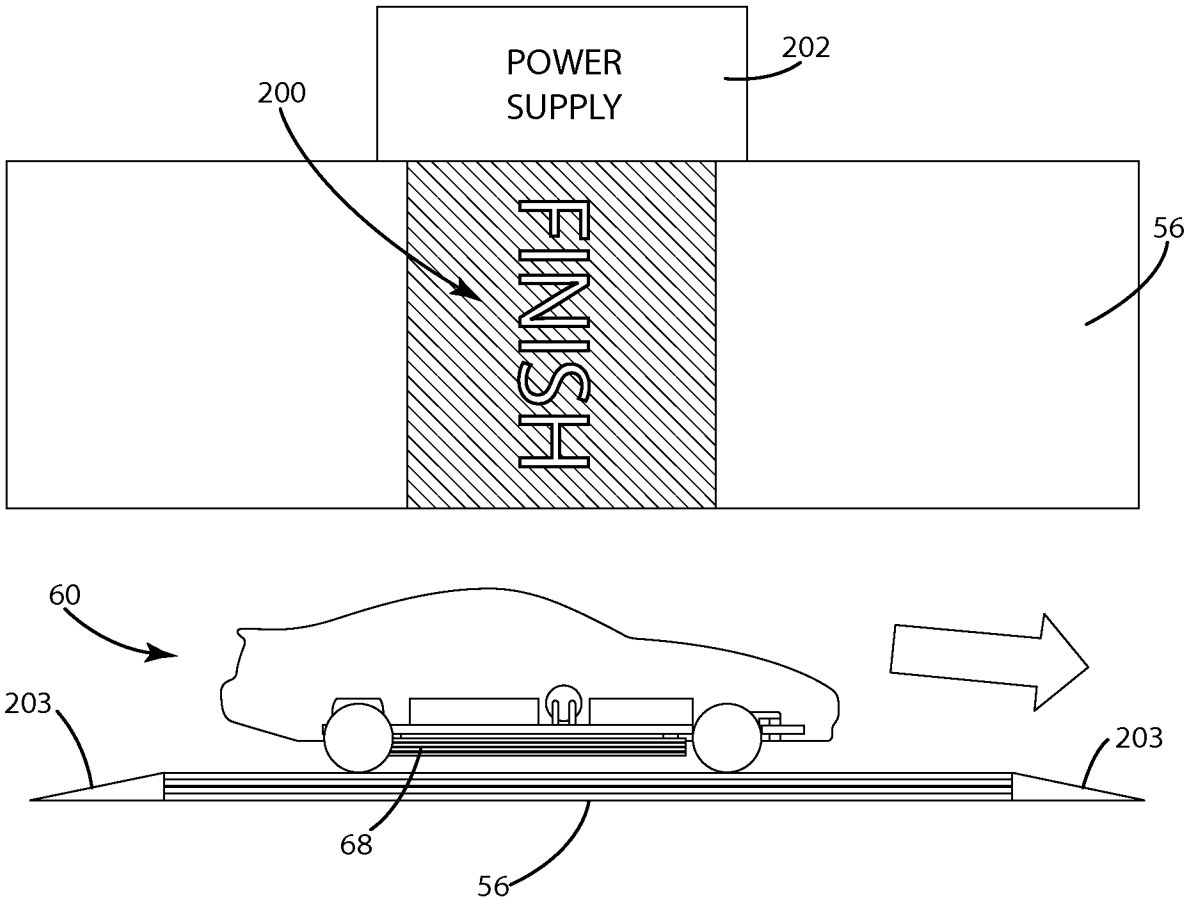
FIG. 29 discloses a toy vehicle and start/finish line containing inductive coils according to at least one embodiment of the present disclosure.

FIG. 29 discloses one embodiment of an inductive charging segment 56 including start/finish line 200 with a power supply 202 and a primary inductive coil (not shown) located within the start/finish line. A car 60 containing a secondary inductive coil 68 and control system (not shown) is controlled by a wireless remote controller (not shown), also containing a secondary coil, operated by a user. As the user drives the car 60 across the start/finish line 200, a charge is received by the vehicle's secondary coil 68 and is stored by the vehicle's onboard storage device. This charge allows for the vehicle to continue operating. For example, a user can position the start/finish line 200 in an area and create a custom race circuit, or simply place the start/finish line 200 in an area that the user decides to operate the vehicle. A display (not shown) contained on the start/finish line 200 and/or the vehicle 60 and its controller provide the user with charge level information. Optionally, the charging segment 56 can include one or more ramps or inclines 203 extending from the lateral edges of the charging segment 56 to permit a car 60 to drive onto and off of the charging segment 56.

Figure 30:
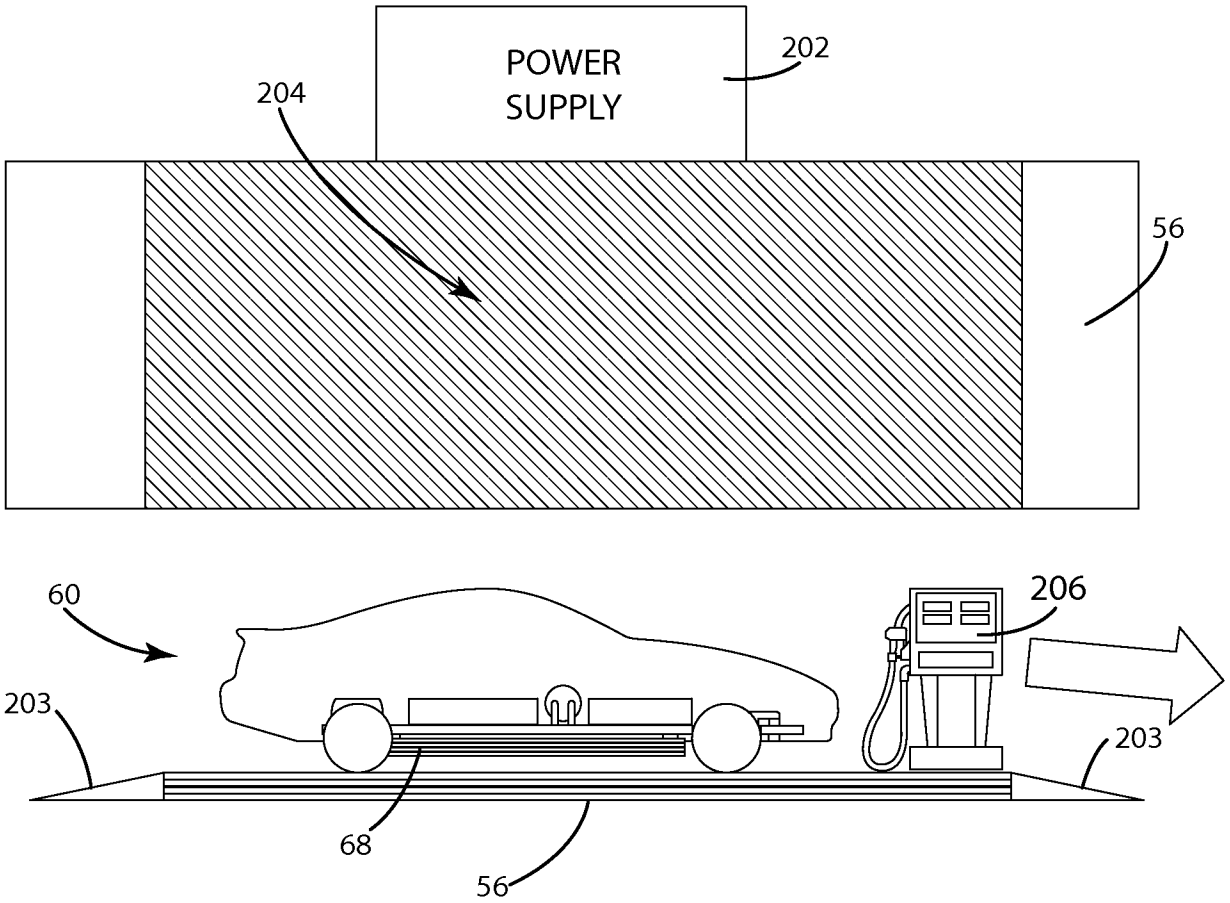
FIG. 30 discloses a toy vehicle and pit stop/gas station containing inductive coils according to at least one embodiment of the present disclosure.

FIG. 30 discloses a charging segment 56 including a charge station or pit stop 204 with a power supply 202 and a primary inductive coil (not shown) located within the pit stop 204. A car 60 containing a secondary inductive coil 68 and control system (not shown) is controlled by a wireless remote controller (not shown), also containing a secondary coil, operated by a user. As the user drives the car 60 across the pit stop 204, a charge is received by the vehicle's secondary coil 68 and is stored by the vehicle's onboard storage device. This charge allows for the car 60 to continue operating. For example, a user can position the pit stop 204 in an area and create a custom race circuit, or simply place the pit stop in an area that the user decides to operate the car 60. A display (not shown) contained on the pit stop 204 and/or the car 60 and its controller provide the user with charge level information. A suitable decoration such as a gas pump 206 may be used to identify the charging location. Optionally, the charging segment 56 can include one or more ramps or inclines 203 extending from the lateral edges of the charging segment 56 to permit a car 60 to drive onto and off of the charging segment 56.

Figure 31:
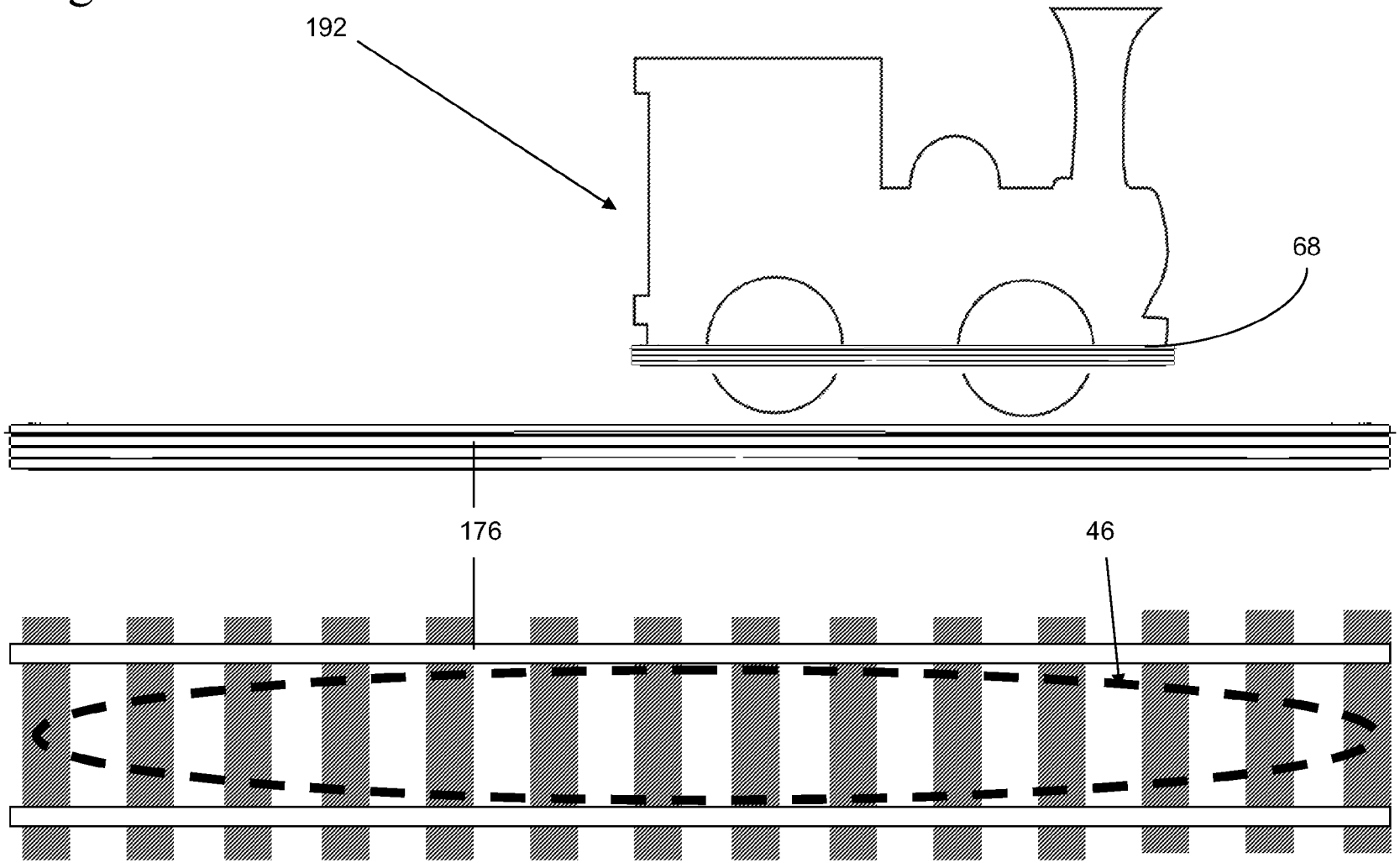
FIG. 31 discloses a toy train and railroad containing inductive coils according to at least one embodiment of the present disclosure.

Though described above in connection with a race car moveable along a toy race track, the present invention can also be incorporated in other toy vehicles, including a toy train 192, a toy boat 194, a toy helicopter 196, or toy airplane 198, for example. As shown in FIG. 31, the present invention can include a train 192 moveable along a railroad track 176 equipped with a primary inductive coil 46. Onboard the train is a wireless control unit 170 according to the present disclosure, and powering the railroad track primary coil is a power and control unit according to the present disclosure. As the user controls the train 192, it moves over the inductive coil 46 incorporated into the railroad track section. In doing so, a charge is received by the secondary coil 68 onboard the train 192, which is stored in a suitable storage device. The train's electric motor then powers the train about the railroad circuit, and receives another charge when it passes over the primary coil equipped track segment again. In this embodiment, a train engine, railroad car, trolley, or other rolling stock may be equipped with secondary coils, energy storage devices, and other controls which may be wirelessly controlled by the user, or automatic in operation. Additionally, as disclosed above, a wireless remote control device equipped with a secondary coil and energy storage device is used to control the train, though a traditional power supply may also be used, to send digital signals through the track while power is supplied by inductive coil. In another embodiment, the primary inductive coil 46 may be incorporated in other railroad accoutrements, such as buildings, landscaping or the rail bed. Locating inductive coils about a train layout provides power to buildings, street lights, and other decorations without traditional wiring.

Figure 32:
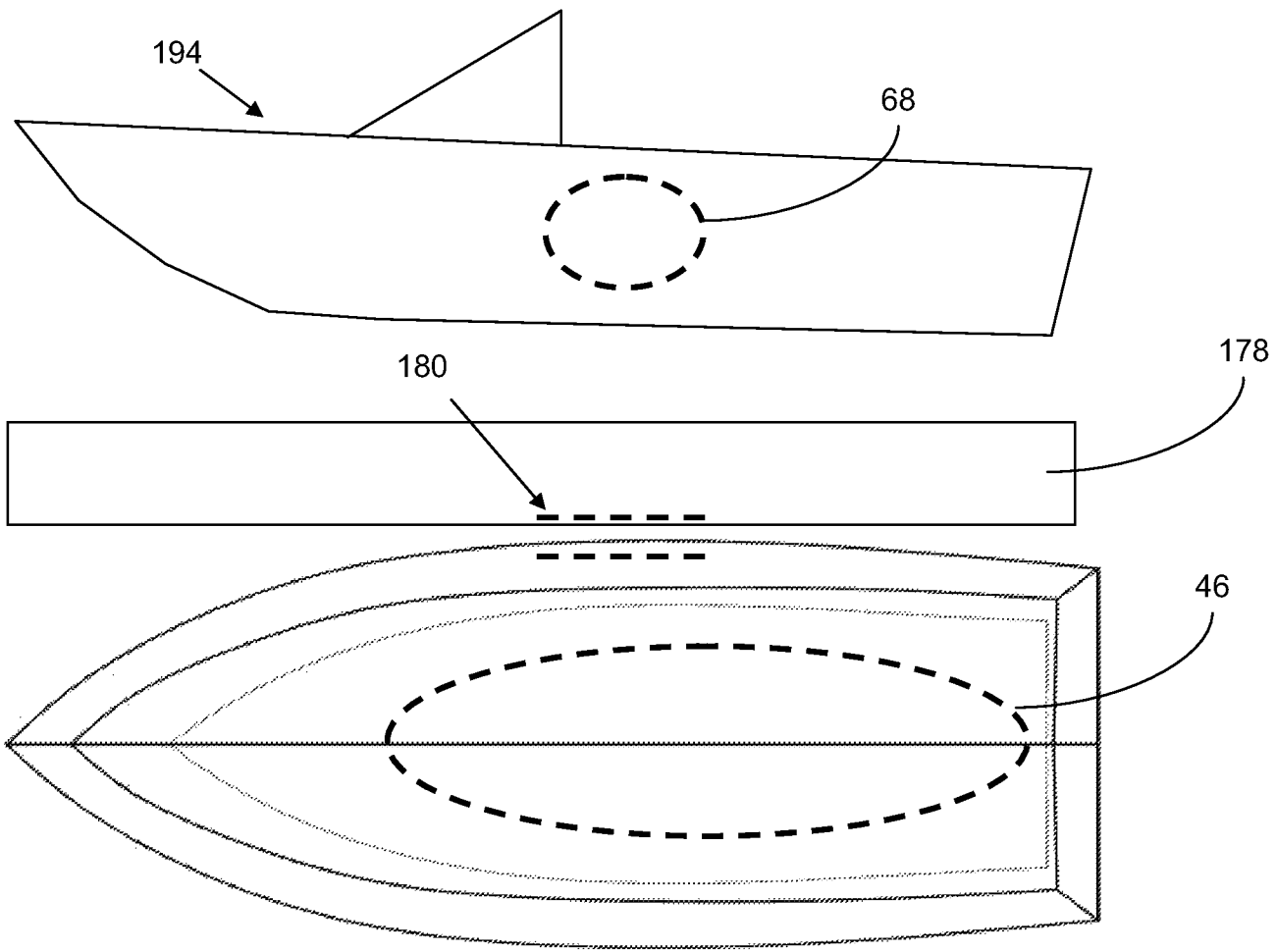
FIG. 32 discloses a boat and dock/poolside containing inductive coils according to at least one embodiment of the present disclosure.

As shown in FIG. 32, the inductively powered vehicle can include a motorized boat 194 having a secondary coil 68 and control system 170 as disclosed above. The boat 194 can be controlled by a wireless remote controller 76 including a secondary coil 68, and the primary inductive coil 46 and associated power supply system circuitry 106 can be incorporated into a portion of a dock or a portion of a poolside 178, for example. As a user operates the boat 194 via the remote controller 76, the boat 194 and/or controller 76 can include a charge condition indicator (not shown) to display the charge level remaining in the boat's onboard energy storage device and control system (not shown) as disclosed above. The display can allow a user to determine when to approach the primary coil equipped portion of the dock or pool side 178. The user can move the boat 194 from that location when the vessel is fully charged, or leave early if desired. In order to maintain a proximity to the primary coil equipped portion 178, a magnet 180 or other restraining device may be used, which may be positioned to prevent the boat 40 from departing until a full charge is received, for example.

Figure 33:
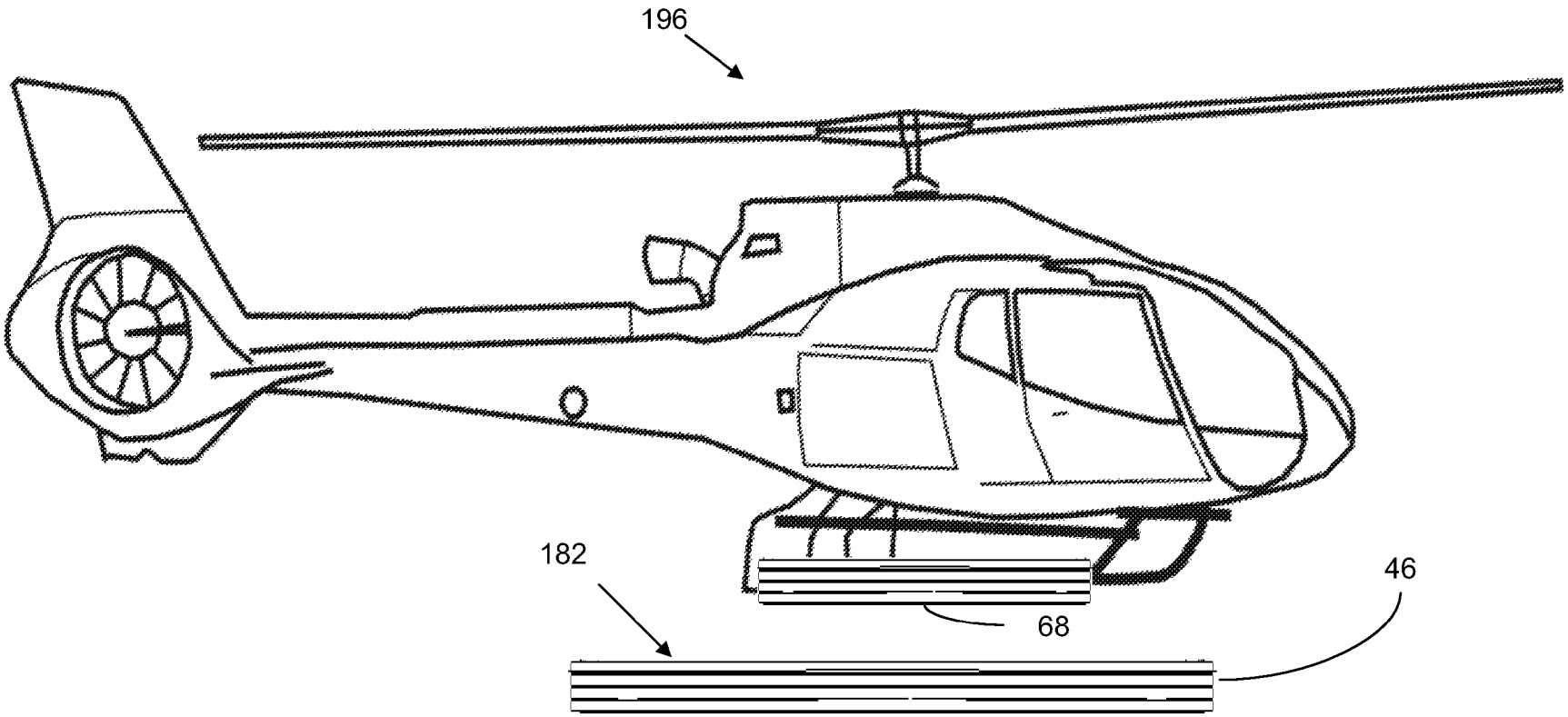
FIG. 33 discloses a toy helicopter and landing pad containing inductive coils according to at least one embodiment of the present disclosure.

FIG. 33 discloses a helicopter 196 with a secondary inductive coil 68 and control system 170 as disclosed above. The helicopter 196 is controlled by a wireless remote controller (not shown), also with a secondary inductive coil. A primary inductive coil 46 and power supply system is incorporated into a landing pad 182 or other suitable object. A user flies the helicopter 196 using the remote controller, and lands it on the landing pad 182 to receive a charge. The controller and/or helicopter 196 provide the user with charge level status. When the user desires, and the helicopter has sufficient charge, it may lift off and resume flight at the user's discretion. The primary coil 46 may be located in other objects aside from a landing pad, such as a target incorporated into a flying game.

Figure 34:
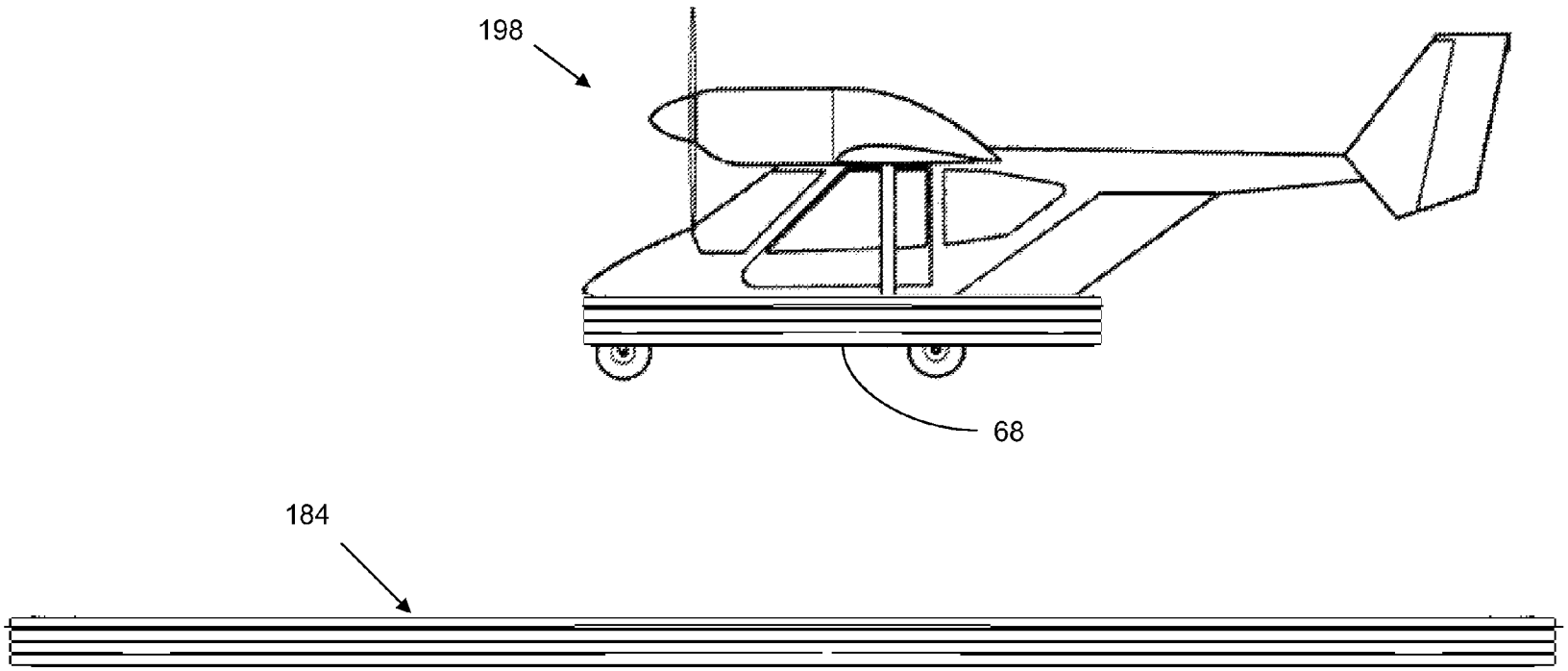
FIG. 34 discloses a toy aircraft and runway containing inductive coils according to at least one embodiment of the present disclosure.

FIG. 34 discloses an airplane 198 with a secondary inductive coil 68 and control system as disclosed above. The aircraft 40 is controlled by a wireless remote controller, also with a secondary inductive coil (not shown). A primary inductive coil 46 and power supply system is incorporated into a runway 184 or other suitable object. The user flies the airplane 198 using the controller and lands on the runway 184 for a charge. The controller and/or aircraft 198 provide the user with charge level status. When the user desires, and the aircraft 198 has sufficient charge, it may lift off and resume flight at the user's discretion. The primary coil 46 may be incorporated into other aviation-related objects, such as a taxiway or aircraft carrier.

Accordingly, additional vehicles may utilize the inductive charging technology as detailed above. For example, toy aircraft such as helicopters or airplanes may be equipped with inductive coils and energy storage devices, along with control systems. A landing pad or runway may also be equipped with a primary inductive coil and power supply, enabling a user to land a craft on such a surface, similar to the track segments as in the race track, and receive a charge for the onboard storage energy storage device. The user can then command the craft to takeoff, using a wireless remote control, and enjoy another electrically-powered flight.

Trains may also be equipped with inductive charging technology. For example, a locomotive may include an inductive coil, energy storage device, and control system, and a railroad segment may include a primary coil and power supply. A user, with a control unit, can command the train to move onto the segment, receiving a charge stored onboard. This segment could be, for example, a train station, coaling depot, or a plurality of segments spaced about a train track layout, each providing a charge to the train locomotive, or other cars being pulled by the train.

Motor boats may also be equipped with inductive charging technology. A boat with a secondary coil can approach a dock, for example, which may include a securing device, such as a magnet, for holding the boat to the dock. Within the dock is a primary coil and power supply. The boat, when fully charged, is released by the dock or the user, and is able to drive about the surface of the water, or underwater, if used in a submersible craft.

Although illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A toy vehicle system comprising:

a track including a charging portion having a primary coil configured to generate an inductive field and a sensor coupled to the charging portion; and a vehicle configured to move along said track, said vehicle including a secondary coil and a load electrically connected to said secondary coil, wherein said load receives electrical power from said secondary coil, and wherein said primary coil is configured to generate the inductive field in response to said sensor detecting when said vehicle is proximate said charging portion of said track, said primary coil being separate from said sensor.

2. The toy vehicle system of claim 1 wherein said charging portion includes a power control unit to provide a time-varying current to said primary coil when said vehicle is proximate said charging portion.

3. The toy vehicle system of claim 1 wherein:

said track includes a plurality of interconnected track segments to form a closed circuit; and said charging portion is substantially included within one of said plurality of track segments.

4. The toy vehicle system of claim 1 wherein said track includes an upper surface to support said vehicle, said primary coil being positioned within said track adjacent said upper surface.

5. The toy vehicle system of claim 1 wherein said load includes an energy storage device, the vehicle system further including a charge condition indicator disposed on one of said vehicle and said track and operable to provide an indication based on the available charge remaining in said energy storage device.

6. The toy vehicle system of claim 1 wherein said track includes a status display unit to display a characteristic of said vehicle performance to a user, wherein said characteristic includes at least one of lap time and lap speed.

7. The toy vehicle system of claim 1 wherein said load includes a drive motor, said vehicle further including an electrical power storage device electrically connected between said secondary coil and said drive motor.

8. The toy vehicle system of claim 7 wherein said drive motor is operable at first and second speed settings based on a detected signal associated with said track.

9. The toy vehicle system of claim 8 wherein said vehicle includes a second sensor to detect said signal associated with said track, said second sensor being one of an electro-magnetic sensor, a mechanical sensor, and an optical sensor.

10. The toy vehicle system of claim 1 wherein:

said vehicle further includes a microcontroller to regulate the operating parameters of said vehicle; and said operating parameters include at least one of said vehicle speed and said vehicle steering.

11. The toy vehicle system of claim 1 further including:

a control unit operated by a user to provide operating instructions to said vehicle; and a wireless communications unit associated with said vehicle to receive operating instructions from said control unit.

12. A race track system comprising:

first and second vehicles each including a secondary coil, an electrical power storage device, and a drive motor, wherein said electrical power storage device is connected between said secondary coil and said drive motor in each of said respective first and second vehicles;

a track including a first charging segment along a first portion thereof and a sensor to detect the presence of one of the first and second vehicles, said first charging segment including a primary coil separate from said sensor and a power control unit to provide a time-varying current to said primary coil to generate a first inductive field in response to said sensor detecting at least one of said first and second vehicles as proximate said first charging segment, wherein said first and second vehicles receive power from said first inductive field when said first and second vehicles traverse said first portion of said track, respectively.

13. The race track system of claim 12 wherein said track is a closed circuit including an upper surface to support a vehicle, said primary coil being positioned adjacent said upper surface to provide inductive power to either of said first and second vehicles when proximate said first charging segment.

14. The race track system of claim 12 wherein said track further includes a second charging segment along a second portion thereof, said second charging segment including a primary coil and a power control unit to provide a time-varying current to said primary coil to generate a second inductive field, wherein said first and second vehicles receive power from said second inductive field when said first and second vehicles traverse said second portion of said track, respectively.

15. The race track system of claim 12 wherein said track includes a plurality of interconnected track segments, wherein one of said plurality of interconnected track segments includes said first charging segment.

16. The race track system of claim 15, wherein said plurality of interconnected track segments are configured to be repositioned by a user to form one of a plurality of shaped tracks.

17. The race track system of claim 12 wherein said sensor is configured to distinguish said first vehicle from said second vehicle.

18. The race track system of claim 12 wherein said sensor includes a Hall Effect sensor to detect the presence of said first vehicle as proximate said first portion of said track.

19. The race track system of claim 12 wherein said sensor includes one of an infrared transmitter and an infrared receiver to detect the presence of said first vehicle as proximate said first portion of said track.

20. The race track system of claim 12 wherein said power control unit is configured to deactivate said drive motor of said first vehicle when said first vehicle is detected as proximate said charging portion of said track.

21. The race track system of claim 12 further including:

a first controller to provide operating instructions to said first vehicle, said first vehicle including a wireless communications unit to receive operating instructions from said first controller; and a second controller to provide operating instructions to said second vehicle, said second vehicle including a wireless communications unit to receive operating instructions from said second controller.

22. The race track system of claim 21 wherein said operating instructions include at least one of vehicle speed and vehicle steering.

23. The race track system of claim 12, wherein said first charging segment is configured to provide wireless power to said first and second vehicles in increments corresponding to successive traversals of said first charging segment by said first and second vehicles.

24. An inductively powered toy vehicle system comprising:

a vehicle including a secondary coil, an electrical power storage device, and a drive motor, wherein said electrical power storage device is connected between said secondary coil and said drive motor; and an inductive power station including a primary coil, a sense circuit and a power control unit, said sense circuit being operable to detect the presence of said vehicle based on a change in impedance of said primary coil and having an output corresponding to said detection, and said power control unit being configured to control a power status of said primary coil based on said sense circuit output.

25. The inductively powered toy vehicle system of claim 24 wherein said vehicle is at least one of a toy car, a toy train, a toy boat, a toy helicopter, and a toy airplane.

26. The inductively powered toy vehicle system of claim 24 further including a display unit to provide an indication of the charge level remaining in said electrical energy storage device.

27. The inductively powered toy vehicle system of claim 24 wherein said power control circuit is configured to deactivate said motor of said vehicle when said vehicle is detected as proximate said inductive power station.

28. The inductively powered toy vehicle system of claim 24 further including a track, wherein said inductive power station is substantially included within said track.

29. The inductively powered toy vehicle system of claim 28 wherein said track includes a plurality of interconnected track segments to form a closed circuit.

30. The inductively powered toy vehicle system of claim 24 further including a vehicle wireless communications unit and a remote control device to provide operating instructions to said vehicle wireless communications unit.

31. The inductively powered toy vehicle system of claim 30 wherein said remote control device includes a remote control secondary coil and a remote control energy storage device, said remote control energy storage device being configured to receive power from said remote control secondary coil when said remote control device is proximate said inductive power station.

32. The inductively powered toy vehicle system of claim 24 wherein controlling the power status of said primary coil includes providing a continuous time-varying current to said primary coil when said vehicle is detected.

33. The inductively powered toy vehicle system of claim 24 wherein said power control unit includes an inverter.

* * * * *